US012680293B2

(12) United States Patent
Whitehead et al.

(10) Patent No.: US 12,680,293 B2
(45) Date of Patent: Jul. 14, 2026

(54) CABANA BAR SHED WITH FOLDING BAR SURFACE

(71) Applicant: SUNCAST TECHNOLOGIES, LLC, Palm Beach Gardens, FL (US)

(72) Inventors: Stephen Whitehead, Elgin, IL (US); Aadal Saeed, Lombard, IL (US); William J. Phillips, Batavia, IL (US); Torrence Anderson, Overland Park, KS (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 96 days.

(21) Appl. No.: 18/885,415

(22) Filed: Sep. 13, 2024

(65) Prior Publication Data

US 2025/0092666 A1 Mar. 20, 2025

Related U.S. Application Data

(60) Provisional application No. 63/584,075, filed on Sep. 20, 2023.

(51) Int. Cl.
*E04B 1/344* (2006.01)
*E04H 1/12* (2006.01)

(52) U.S. Cl.
CPC ..... *E04B 1/3444* (2013.01); *E04H 1/1222* (2013.01)

(58) Field of Classification Search
CPC ..... E04B 1/3444; E04B 1/344; E04B 1/3441; E04B 1/3442; E04B 1/3447;
(Continued)

(56) References Cited

U.S. PATENT DOCUMENTS 1,457,751 A * 6/1923 Roberts ..... A47B 5/06 248/240.1
2,255,185 A * 9/1941 Phalen ..... A01K 1/02 52/262

(Continued)

FOREIGN PATENT DOCUMENTS

AU 2006101110 A4 * 1/2013
CN 101501282 A * 8/2009 ..... E04B 1/98

(Continued)

OTHER PUBLICATIONS

Notification of the International Search Report of the International Searching Authority for PCT/US2024/046837, mailed Dec. 2, 2024, pp. 1-3, (2024).

(Continued)

*Primary Examiner* — Brian D Mattei
*Assistant Examiner* — Joseph J. Sadlon
(74) *Attorney, Agent, or Firm* — McHale & Slavin, P.A.

(57) ABSTRACT

The invention involves a cabana shed having a folding bar surface. The cabana shed is constructed from lightweight blow molded panels that can be shipped in a knocked down state and assembled on site with minimal tools and strength. The cabana shed includes four walls, a floor, and a roof, all secured together into a robust structure capable of withstanding winds, rain, snow loads, and the like, while maintaining a dry interior. An upward lifting panel is provided in a front wall of the structure. The upward lifting panel provides shade for the bar surface while in a lifted position, and allows patrons to sit at the bar even in the rain. The panel is closable when the bar is in a folded state to allow the shed to be completely enclosed.

14 Claims, 34 Drawing Sheets

(58) Field of Classification Search
CPC ... E04B 1/3449; E04H 1/1222; E04H 1/1244; E04H 1/1255; E04H 1/1272; E04H 2001/1288; E04H 2001/1294; E04F 10/10
USPC ..... 52/69, 79.1
See application file for complete search history.

(56) References Cited

U.S. PATENT DOCUMENTS 2,717,429 A * 9/1955 Nead ..... E04B 1/3445 52/70
2,771,334 A * 11/1956 Wahlbom ..... A47B 69/00 312/258
3,284,971 A * 11/1966 Attwood ..... A47B 96/1408 52/842
3,774,357 A * 11/1973 Moore ..... E04H 1/12 52/36.2
3,848,375 A * 11/1974 White ..... A47B 43/00 312/258
3,984,949 A * 10/1976 Wahlquist ..... E04B 2/74 52/143
4,164,095 A * 8/1979 Musacchia ..... E06B 5/00 49/141
D255,517 S * 6/1980 Gale ..... D6/699
4,236,359 A * 12/1980 Woolford ..... E04H 1/1272 D25/1
4,265,059 A * 5/1981 Johnson ..... E04H 12/182 D25/16
4,672,779 A * 6/1987 Boyd ..... E04H 15/001 52/79.5
5,363,608 A * 11/1994 Conlan ..... E04H 1/1211 52/66
5,664,384 A * 9/1997 Cullinan ..... F24F 13/20 52/72
5,671,568 A * 9/1997 Armanno, Sr. ..... E04H 9/14 52/80.1
5,690,239 A * 11/1997 Ballard ..... A47F 5/0846 211/187
5,692,342 A * 12/1997 Devlin, Jr. ..... A47F 10/00 52/36.2
6,060,144 A * 5/2000 Kimura ..... E04C 2/246 428/92
6,240,855 B1 * 6/2001 Pirkl ..... A47F 3/001 108/115
6,286,269 B1 * 9/2001 Marcum ..... A01M 31/02 52/270
6,415,558 B1 * 7/2002 Cherry ..... E04H 9/14 52/270
6,701,678 B1 * 3/2004 Skov ..... E04H 1/1205 52/79.9
6,748,703 B1 * 6/2004 Mandart ..... E01F 1/00 52/36.2
6,802,158 B1 * 10/2004 Greene ..... E04H 1/1205 52/36.2
7,273,261 B2 * 9/2007 DeMars ..... A47F 9/00 312/258
7,543,411 B2 * 6/2009 Whitehead ..... E04B 1/34321 52/66
7,721,496 B2 * 5/2010 Carlson ..... B29C 44/06 52/843
7,770,339 B2 * 8/2010 Mower ..... E04B 1/34321 52/79.5
7,963,073 B1 * 6/2011 Pellegrene ..... E04B 1/34869 52/79.11
8,109,044 B2 * 2/2012 Graber ..... A47K 3/30 52/36.2
8,776,449 B1 * 7/2014 Rowan ..... E04H 1/1205 52/79.1
9,032,670 B2 * 5/2015 Vogler ..... E04H 1/005 52/79.9
9,085,890 B2 * 7/2015 Strickland ..... E04B 1/34321
10,124,710 B2 * 11/2018 El-Wakeel ..... B62B 5/0013
10,851,552 B1 * 12/2020 DeMatteis ..... E04H 1/1205
10,851,553 B2 * 12/2020 Dunn ..... A47F 9/00
10,889,984 B2 * 1/2021 Arguin ..... E04F 13/0894
10,985,689 B2 * 4/2021 Wickramasekera .. E04H 1/1205
11,473,290 B2 * 10/2022 Miacolo ..... E04H 1/1205
11,672,341 B2 * 6/2023 Hanna ..... G05B 19/042 297/16.2
12,284,953 B2 * 4/2025 Shanmuganathan .... A01G 9/14
12,492,549 B2 * 12/2025 Vasconi ..... B64U 70/90
12,604,997 B2 * 4/2026 Gessi ..... A47F 5/0815
12,612,786 B2 * 4/2026 Flann ..... E04F 10/08
2003/0029099 A1 2/2003 Torata
2004/0187400 A1 * 9/2004 Anderson ..... E04B 1/34321 52/79.1
2016/0168905 A1 * 6/2016 Liao ..... E04F 10/10 160/115
2017/0370116 A1 * 12/2017 Cincotta ..... B60P 3/32
2018/0274256 A1 * 9/2018 El-Wakeel ..... E04H 1/1222
2019/0316343 A1 * 10/2019 Matsuoka ..... E04B 1/3441
2020/0207485 A1 * 7/2020 Foggia ..... B64U 70/90
2022/0074195 A1 * 3/2022 Pitt ..... E04B 1/34869
2023/0243145 A1 * 8/2023 Kale ..... E04B 1/34305 52/86

FOREIGN PATENT DOCUMENTS

CN 103821387 A 5/2014
CN 103821387 B * 10/2015
CN 116464125 A * 7/2023 ..... E03B 5/02
DE 3105225 A1 * 9/1982 ..... A47F 5/108
DE 4234615 A1 * 6/1993 ..... B65D 88/522
DE 202019101485 U1 * 6/2020 ..... E04B 1/3444
EP 1538271 A2 * 6/2005 ..... E04B 1/3444
KR 102068433 B1 * 1/2020 ..... G09F 13/0413
WO WO-03033831 A1 * 4/2003 ..... E04B 1/14
WO WO-2020056309 A1 * 3/2020 ..... G06Q 10/083

OTHER PUBLICATIONS

Written Opinion of the International Searching Authority for PCT/US2024/046837, mailed Dec. 2, 2024, pp. 1-8, (2024).

* cited by examiner

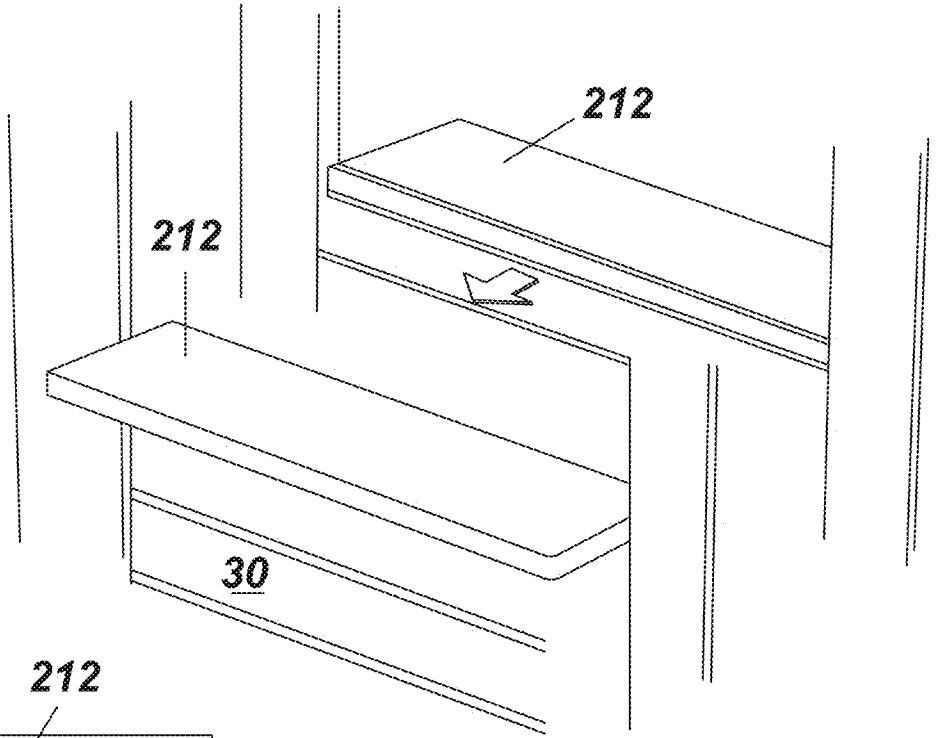
Fig. 23B
Fig. 23A
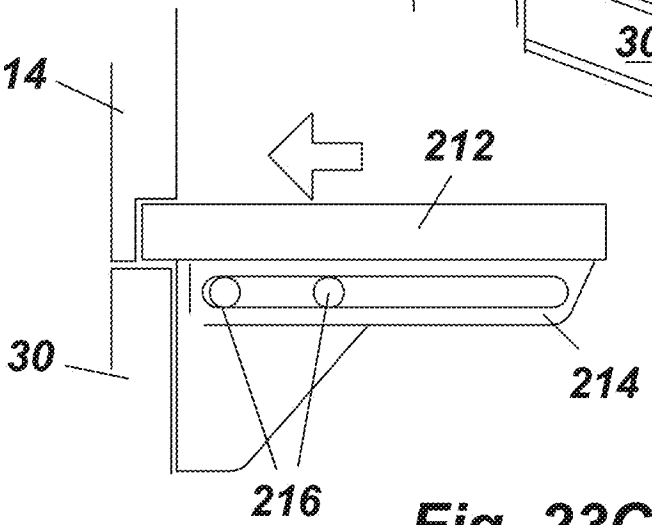
Fig. 23C

CABANA BAR SHED WITH FOLDING BAR SURFACE

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 63/584,075, entitled "CABANA BAR SHED WITH FOLDING BAR SURFACE", filed Sep. 20, 2023. The contents of the above referenced application are incorporated herein by reference in their entirety.

FIELD OF INVENTION

The present invention generally relates to cabana bars, and more particularly, to a blow molded shed having a folding bar surface and upwardly opening sidewalls.

BACKGROUND INFORMATION

Cabanas are generally small structures positioned near a pool or the beach which may be used for changing clothes, providing a cool shady spot, bathrooms or the like. Cabana bars are also generally positioned in proximity to pools, lakes or other bodies of water or groups of people.

One drawback to the standard designs of known cabana bars relates to the construction of the bar. The cabana bar is typically a permanent structure built to include a roof and a flat bar at one side of the structure. Sometimes tilting walls are provided to close the structure. However, in the area of the bar surface, the walls close over a top surface of the bar with the bar extending outwardly with respect to the front surface of the building. This provides a path for rainwater to easily run across the bar surface to the interior of the building. The opening also allows bugs and the like a path to enter the building which may contain sugary drinks and food. This construction is therefore less than desired, and is only tolerated by those such as hotels that can provide the necessary daily maintenance and cleaning that is required.

Another drawback relates to the weight of the movable panels used to cover the opening. A full sheet of half inch thick plywood weighs over 40 pounds. That does not include any framing for the plywood to maintain its shape or any metal hardware used to secure the panel in the open and closed positions. Thus, a moving panel on a small 8 foot long cabana bar can easily weigh 60-80 pounds or more. This is a significant amount of weight considering that the panel must be raised above head height to properly open the panel for use of the bar surface.

Thus, the present invention provides a cabana bar shed which overcomes the disadvantages of prior art. The cabana bar structure of the present invention not only provides for relative ease in the assembly, it also permits a lightweight overall structure that can withstand large wind loads. The cabana bar structure includes a folding bar surface that hides behind one of the structure walls when closed.

Finally, there are ergonomic needs that a cabana bar shed must satisfy in order to achieve acceptance by the end user. The cabana bar shed must be easily and quickly assembled using minimal hardware and requiring a minimal number of tools. Further, the cabana bar shed should not require excessive strength to assemble or include heavy component parts that make operation of the cabana bar suitable for most people. Moreover, the system must assemble together in such a way so as not to detract from the aesthetic appearance of the assembled snow shovel or snow pusher device.

SUMMARY OF THE INVENTION

Briefly, the invention involves a cabana shed having a folding bar surface. The cabana shed is constructed from lightweight blow molded or injection molded plastic panels that can be shipped in a knocked down state and assembled on site with minimal tools and strength. The cabana shed includes four walls, a floor and a roof all secured together into a robust structure capable of withstanding winds, rain, snow loads and the like while maintaining a dry interior. An upward lifting panel is provided in at least a front wall of the structure. The upward lifting panel provides shade for the bar surface while in a lifted position and allows patrons to sit at the bar, even in the rain. The panel is closable when the bar is in a folded state to allow the shed to be completely enclosed. This construction hides the fact that the shed is a bar and prevents easy access to any alcohol that may be stored in the shed. The closure of the panel also provides weatherproofing to the shed, eliminating the flat surface that catches rain and directs it into the shed as seen in conventional cabana buildings. Still yet, the panel provides bug resistance by enclosing the opening in the shed, eliminating any opening above the bar surface as seen in the prior art.

Accordingly, it is an objective of the present invention to provide a cabana shed having a tilting bar surface.

It is a further objective of the present invention to provide a cabana shed having a rotating panel that encloses at least the side of the cabana shed, including the folding surface.

It is yet a further objective of the present invention to provide a mechanism for a folding bar surface that allows the bar surface to be stored behind a rotating wall panel.

It is another objective of the instant invention to provide a shed suitable for use as a cabana bar.

It is still yet another objective of the present invention to provide a cabana shed having the tilting wall constructed from lightweight blow molded plastic.

It is an even further objective of the present invention to provide a cabana shed having an injection molded tilting wall, wherein the tilting wall includes integral ribs and gussets to provide structure to the wall panel.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

BRIEF DESCRIPTION OF THE FIGURES

FIG. 23A is a top, front, right perspective view illustrating a sliding bar surface for creating the cabana shed;

FIG. 23B is a top, front, right perspective view illustrating sliding the bar from a storage position to a use position;

FIG. 23C is a side view illustrating the motion provided by the sliding bar top;

DETAILED DESCRIPTION OF THE PREFERRED EMBODIMENTS

Figure 1:
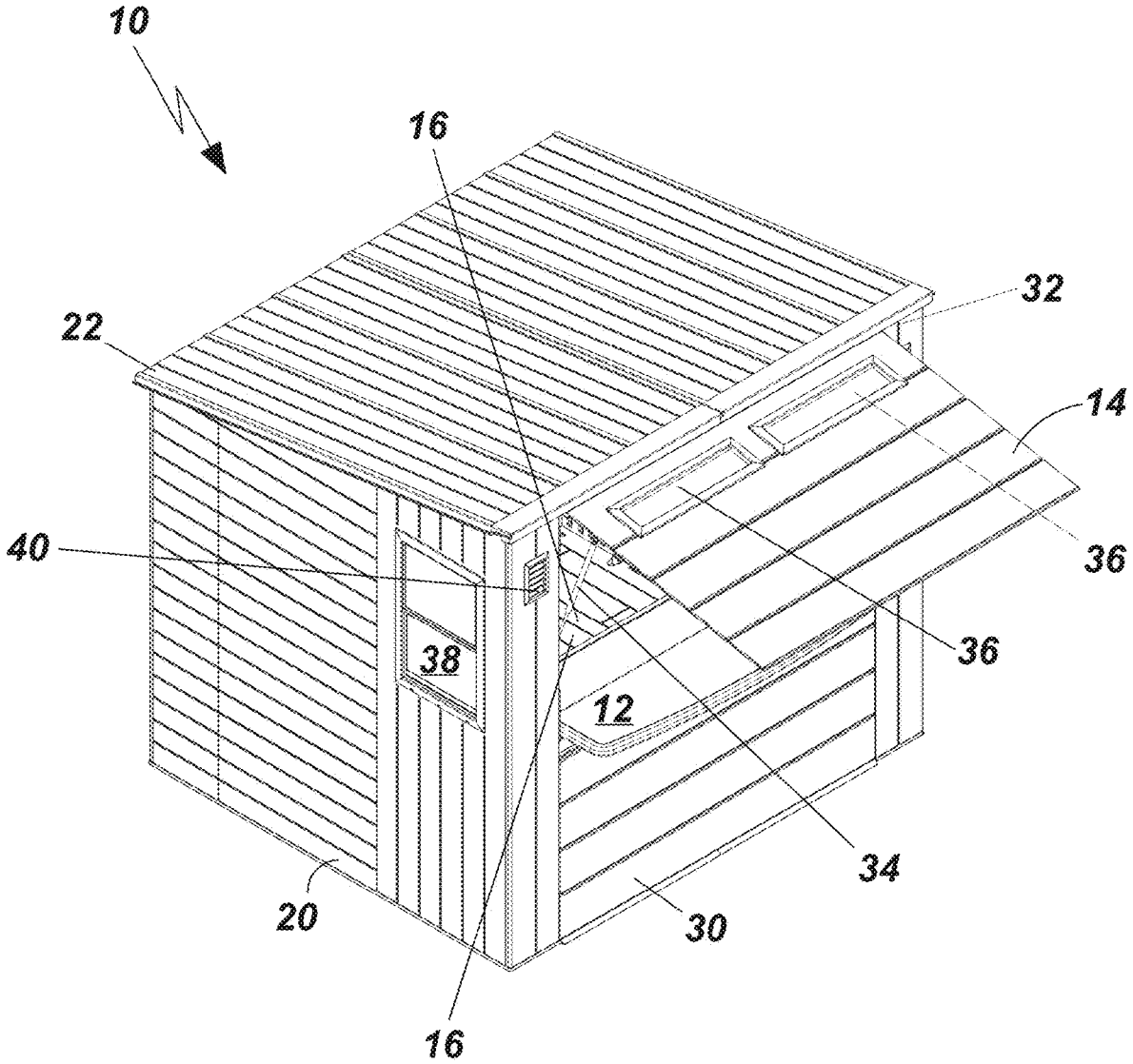
FIG. 1 is a top, front, left perspective view of one embodiment of a cabana shed having a tilting bar surface and pivoting wall panel.
Figure 2:
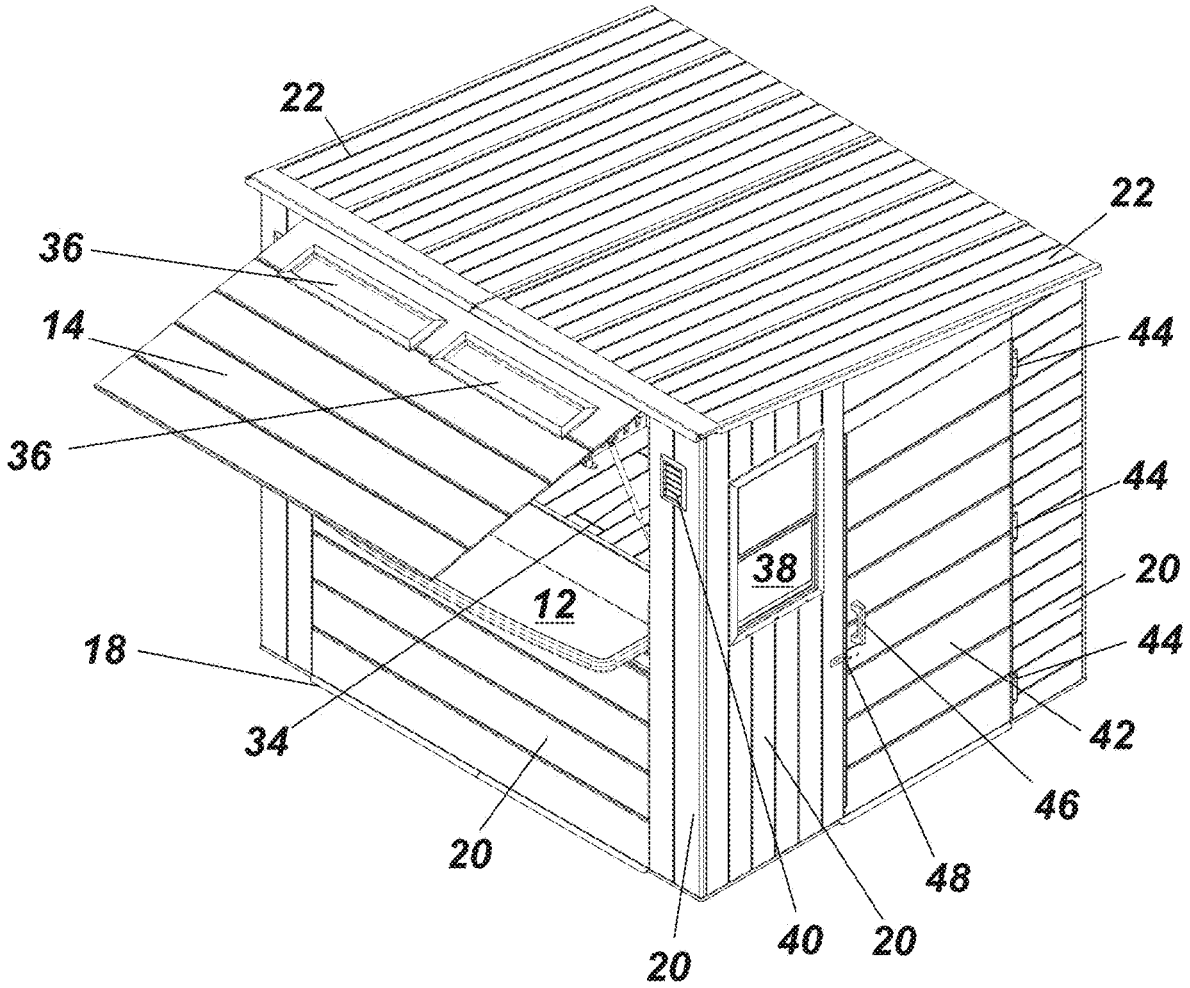
FIG. 2 is a top, front, right perspective view of the cabana shed of FIG. 1.
Figure 3:
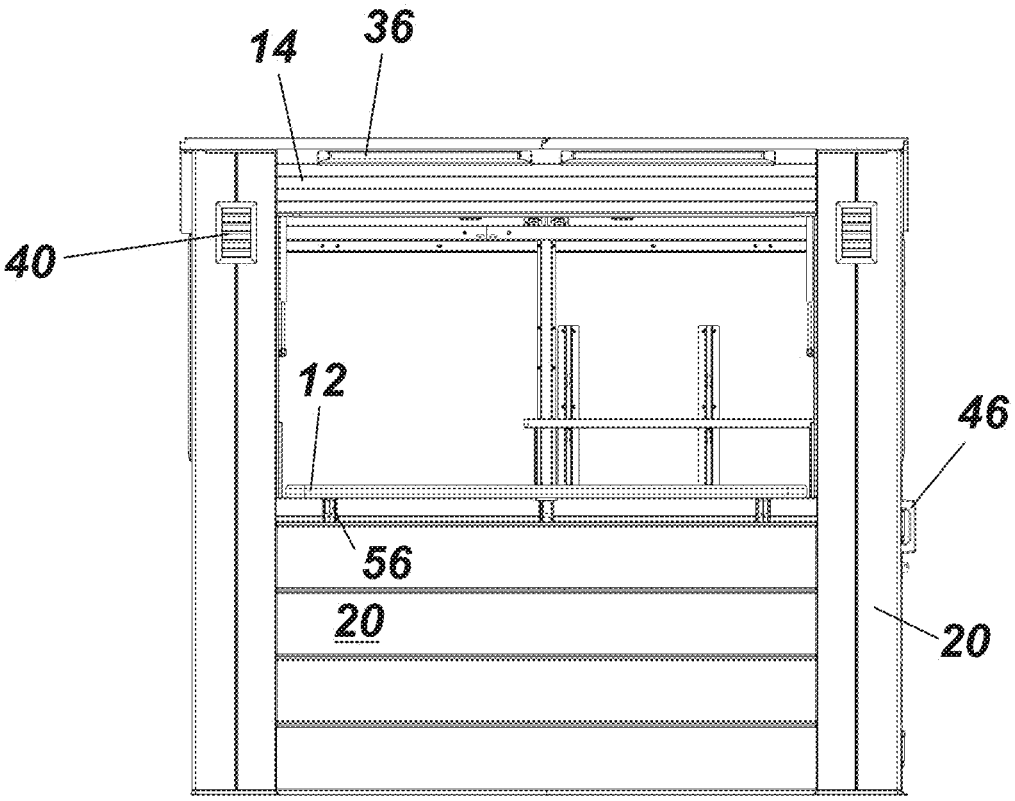
FIG. 3 is a front view of the embodiment shown in FIG. 1.
Figure 4:
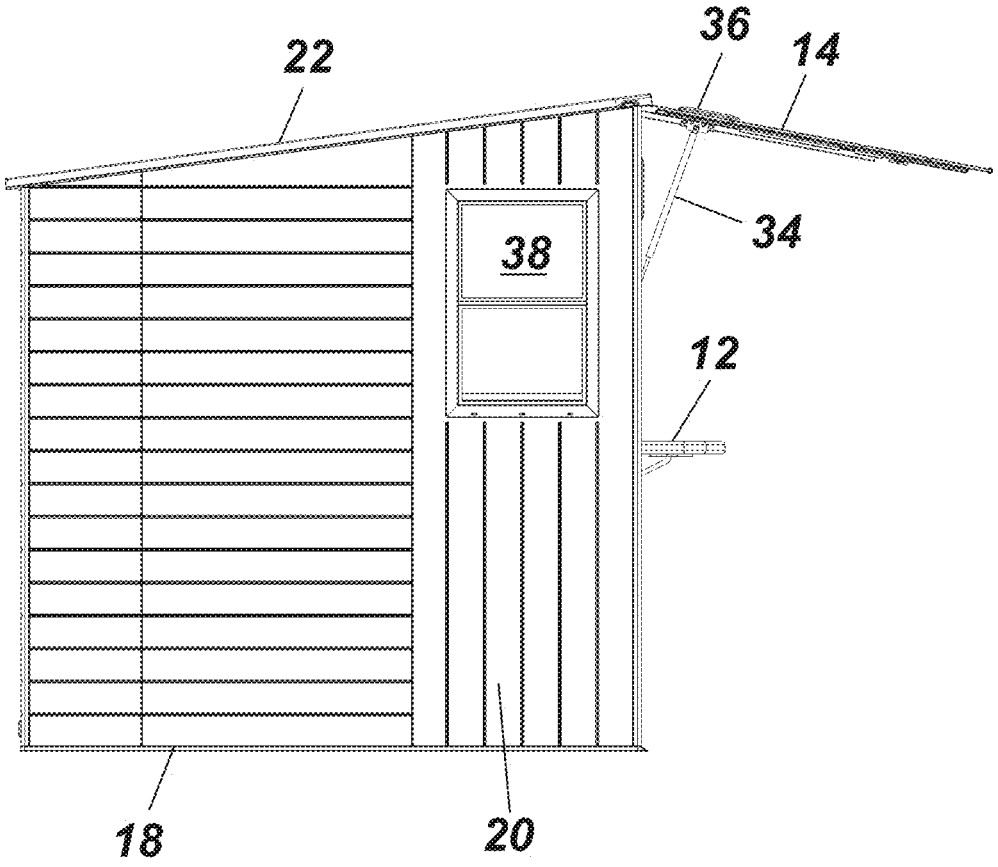
FIG. 4 is a left side view of the embodiment shown in FIG. 1.
Figure 5:
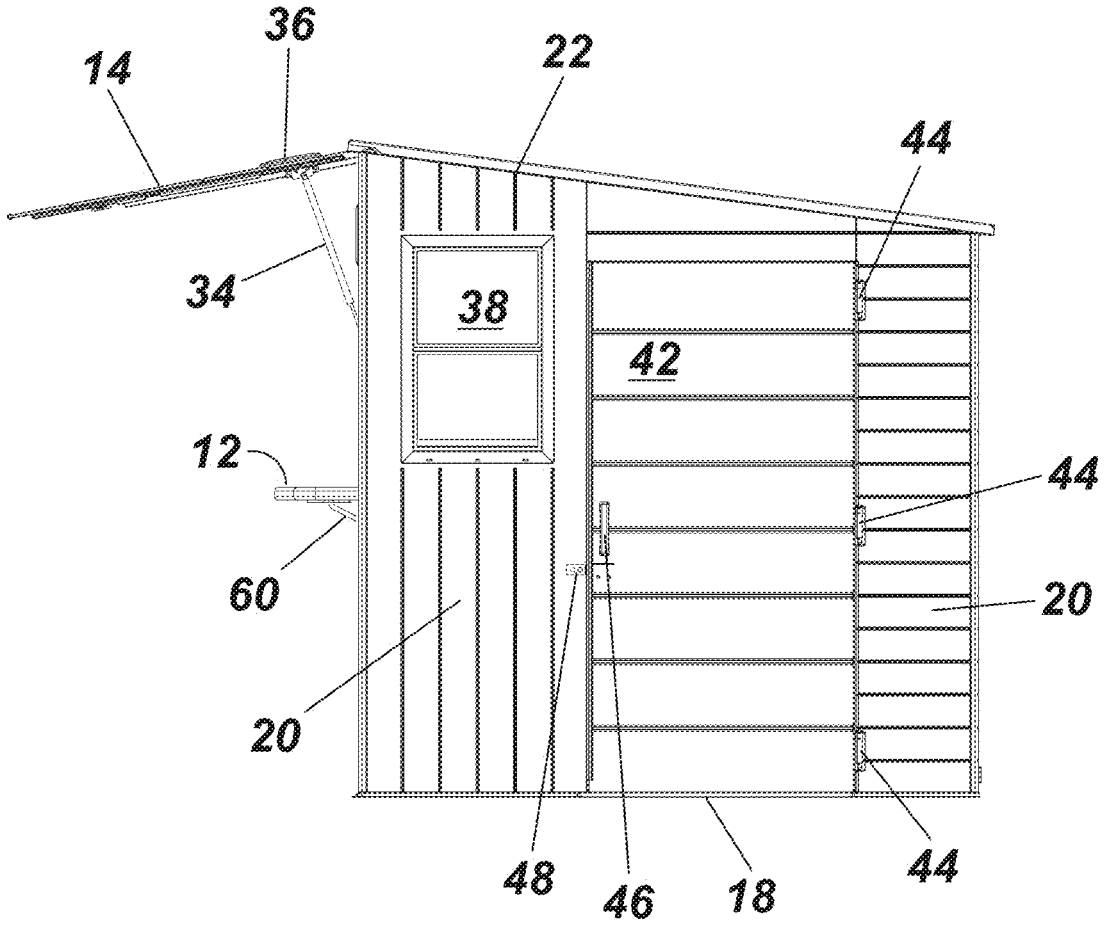
FIG. 5 is a right side view of the embodiment shown in FIG. 1.
Figure 6:
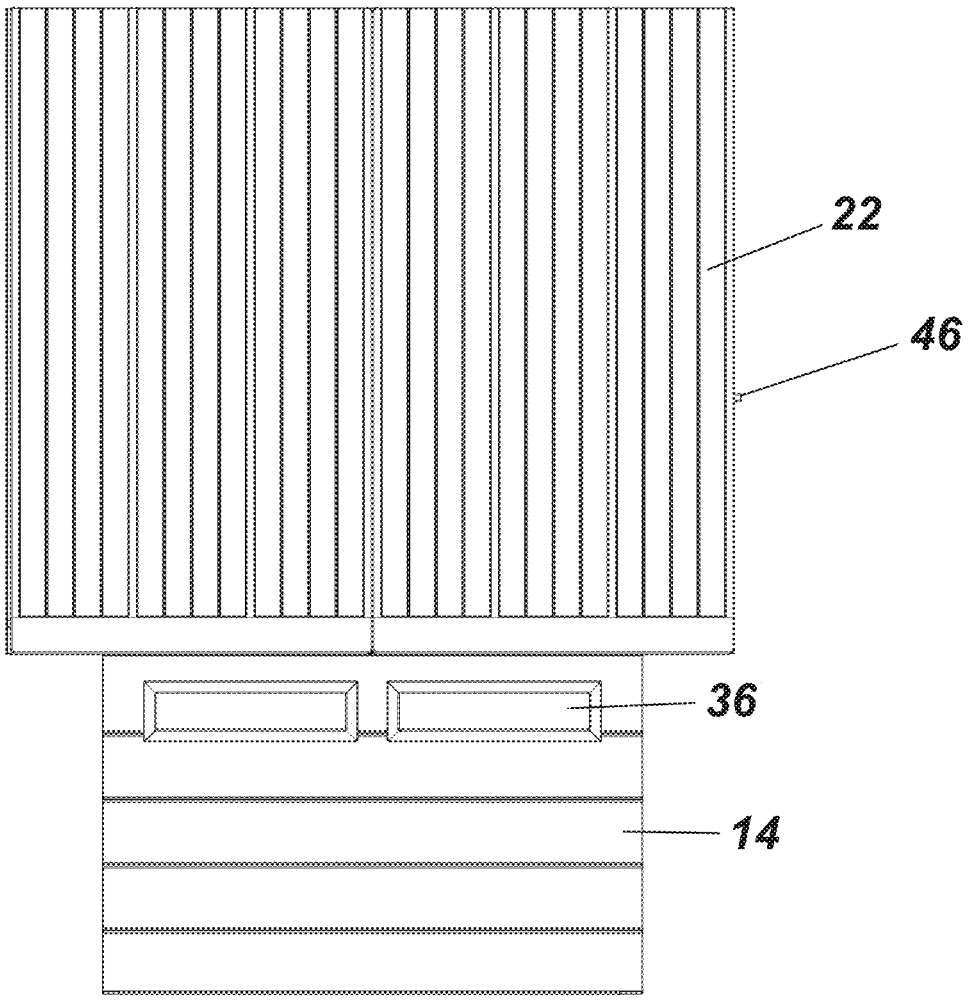
FIG. 6 is a top view of the embodiment shown in FIG. 1.
Figure 7A:
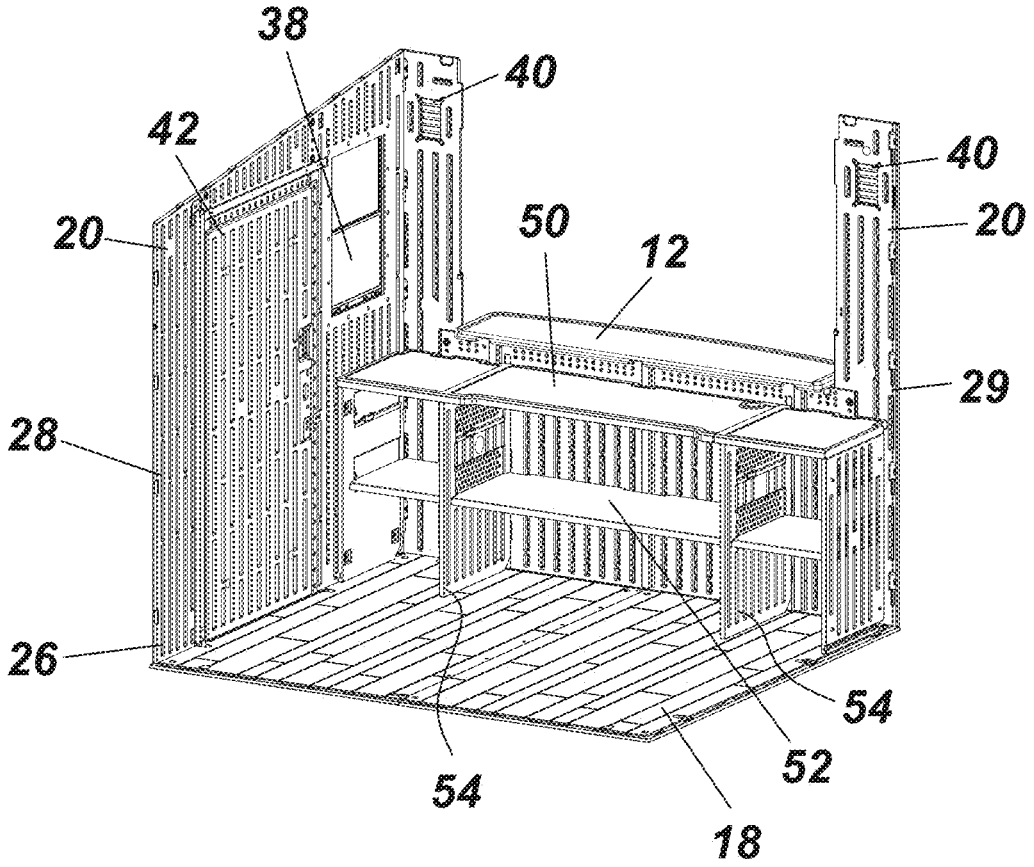
FIG. 7A is a partial rear, top, left perspective view of the embodiment shown in FIG. 1, illustrated having the rear, left and roof panels omitted for viewing the inside of the cabana shed.
Figure 7B:
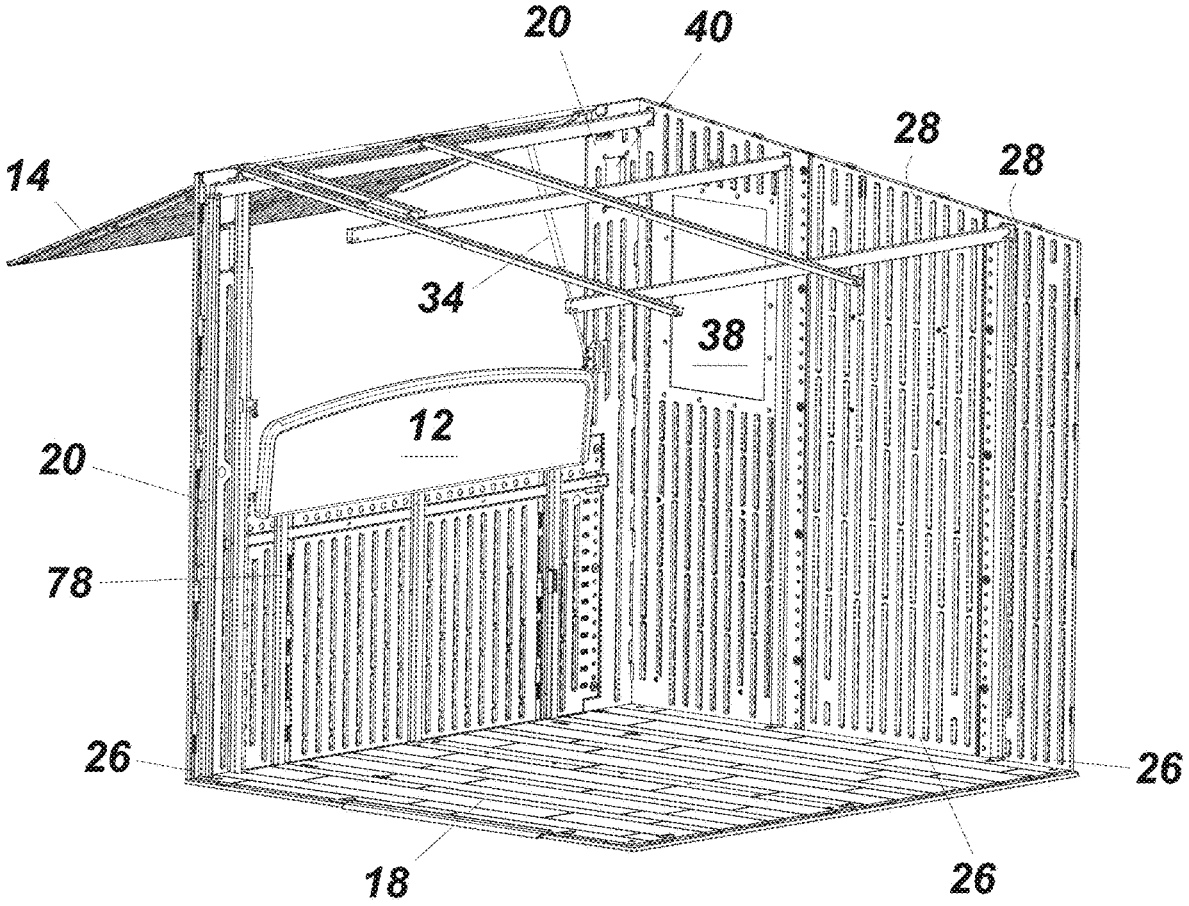
FIG. 7B is a partial rear perspective view having a portion of the walls removed to illustrate the bar surface in a folded position and the cover panel raised vertically.
Figure 7C:
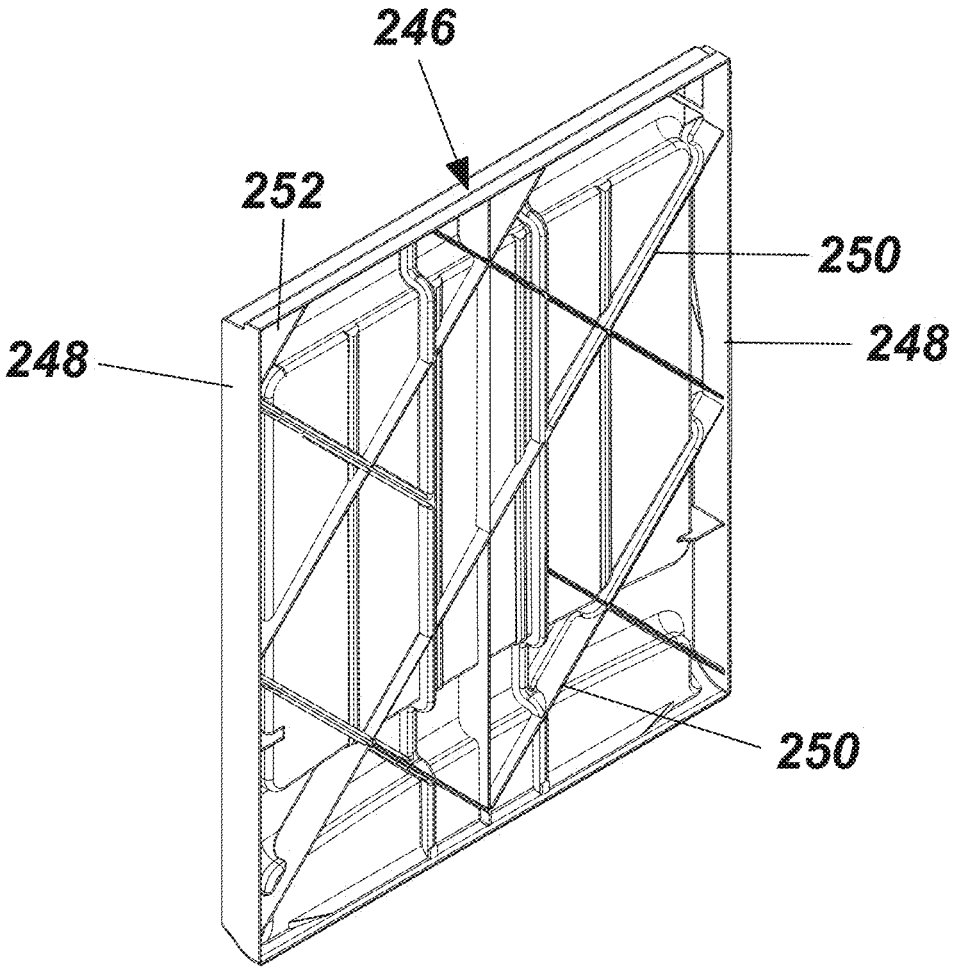
FIG. 7C is a rear perspective view of a panel constructed with the process of injection molding being hollow and including integral ribs and gussets.
Figure 8:
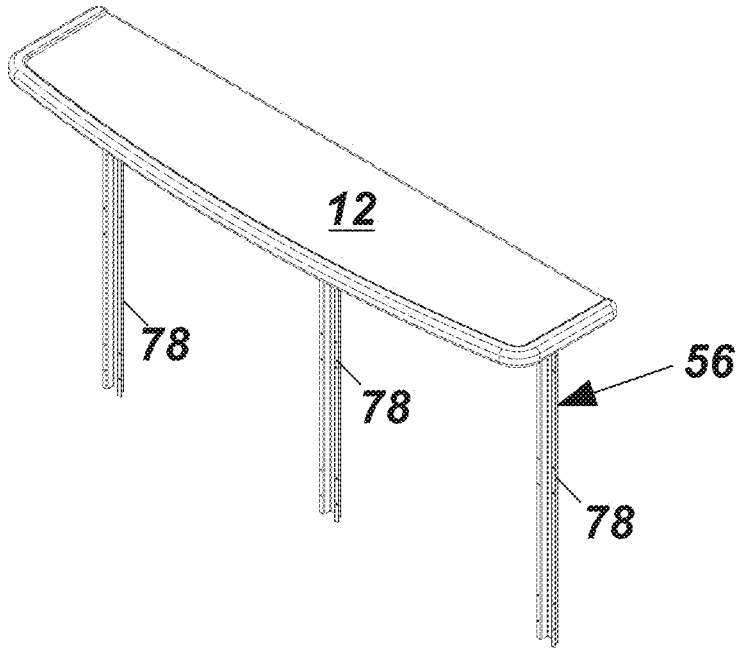
FIG. 8 is a top, right perspective view of the tilting bar surface shown in FIG. 1.
Figure 9:
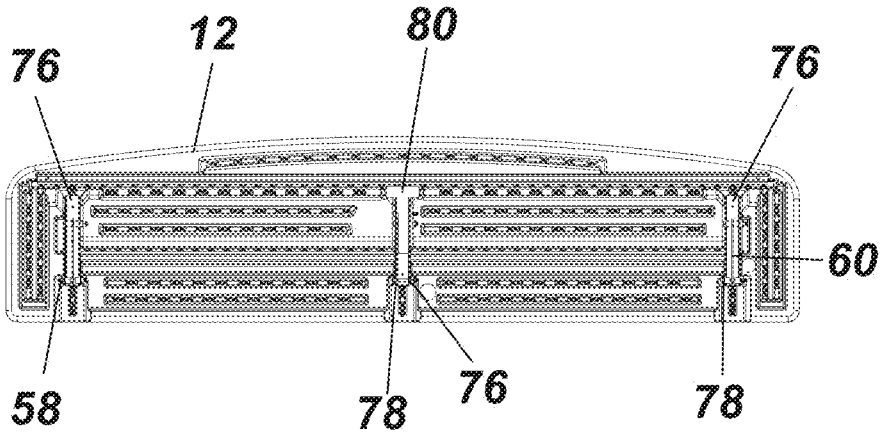
FIG. 9 is a bottom view of the tilting bar embodiment shown in FIG. 8.
Figure 10:
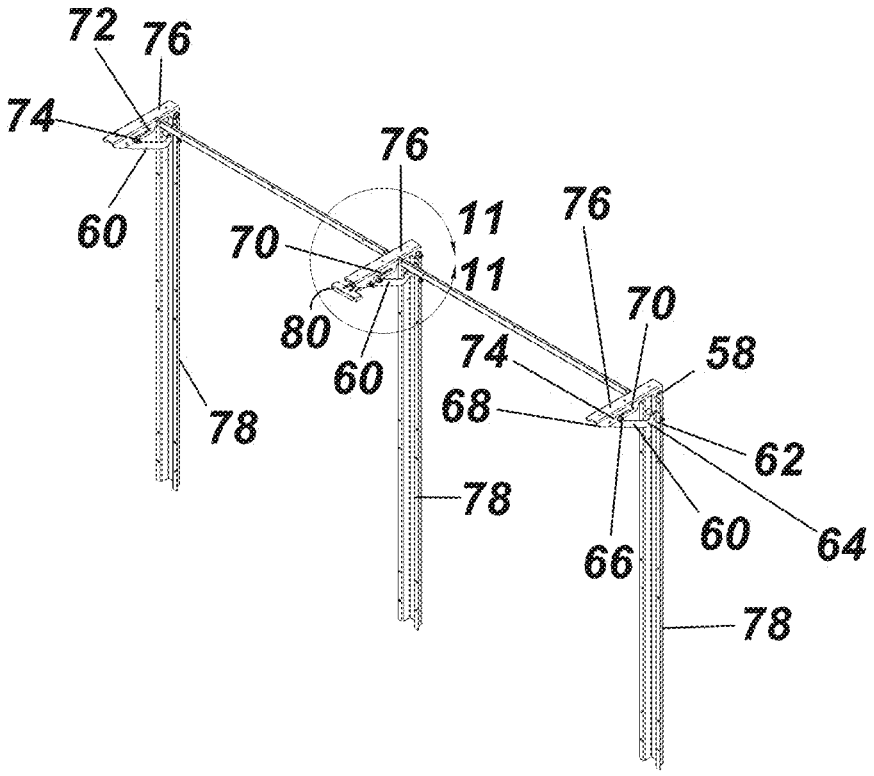
FIG. 10 is a front, top, right perspective view of the tilting support structure of the tilting bar surface.
Figure 11:
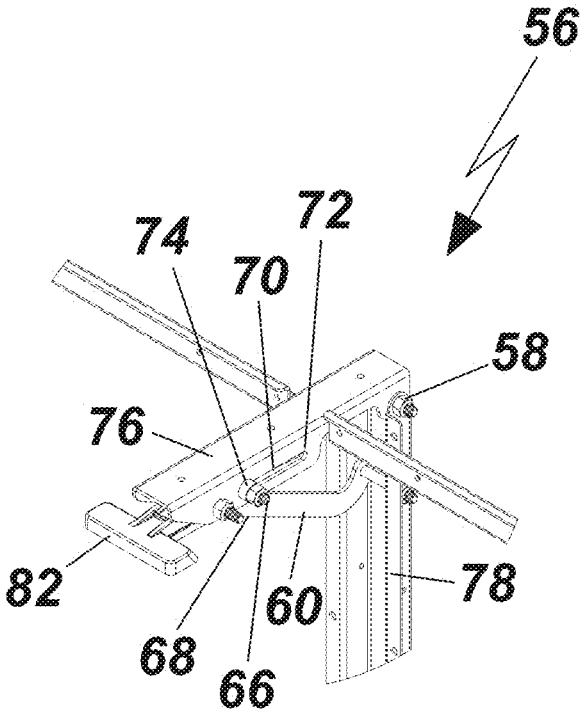
FIG. 11 is a partial perspective view of the tilting support structure taken along lines 11-11 of FIG. 10.
Figure 12A:
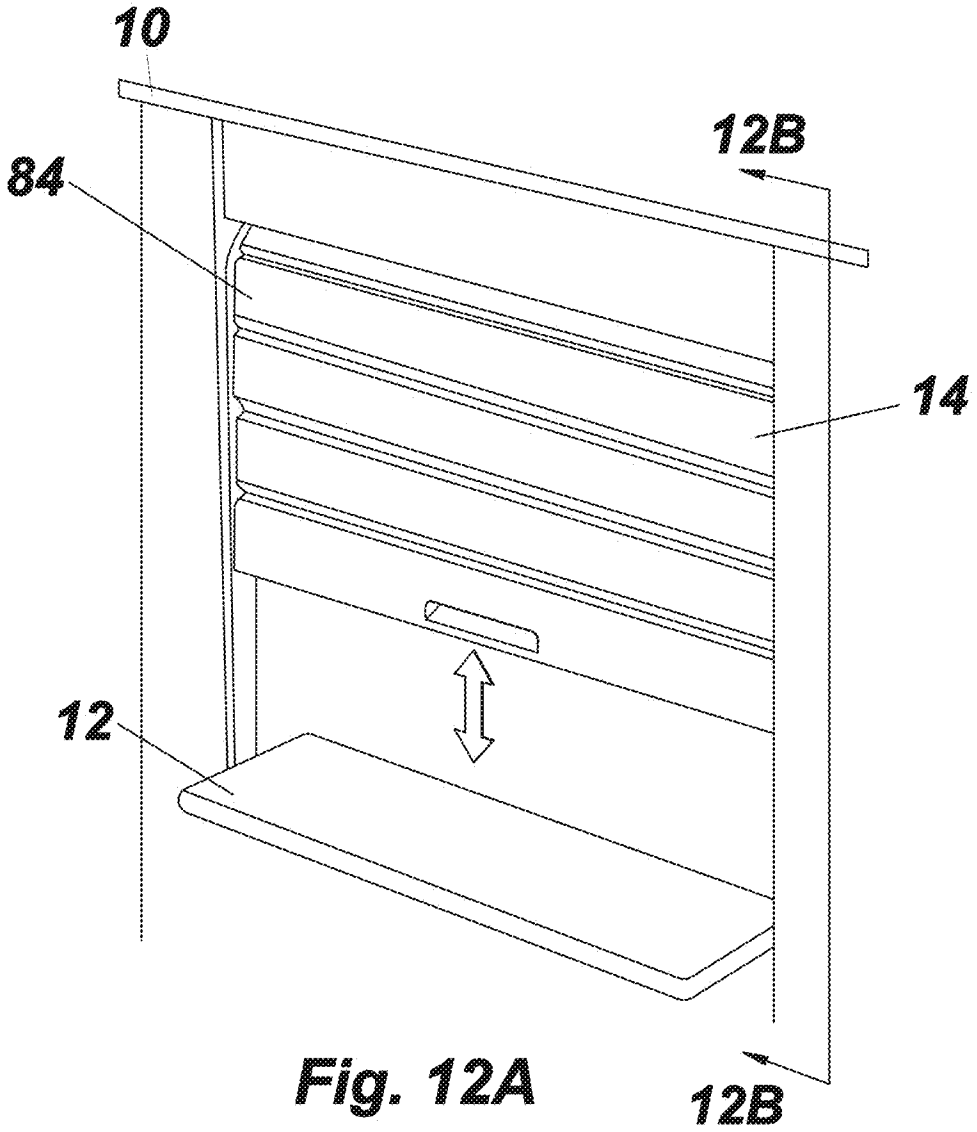
FIG. 12A is a front, right perspective view of a garage style door suitable for use on the cabana shed.
Figure 12B:
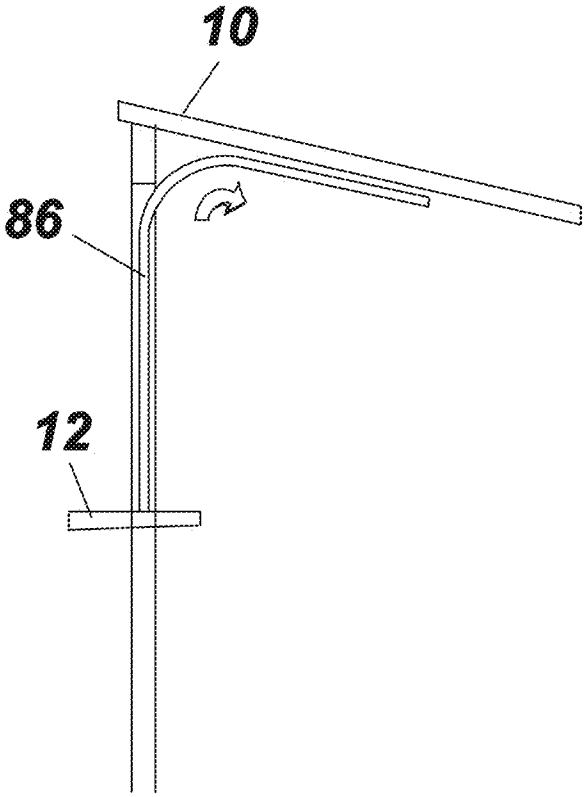
FIG. 12B is a side view taken along lines 12B-12B of FIG. 12A illustrating the track for the garage style door.
Figure 13A:
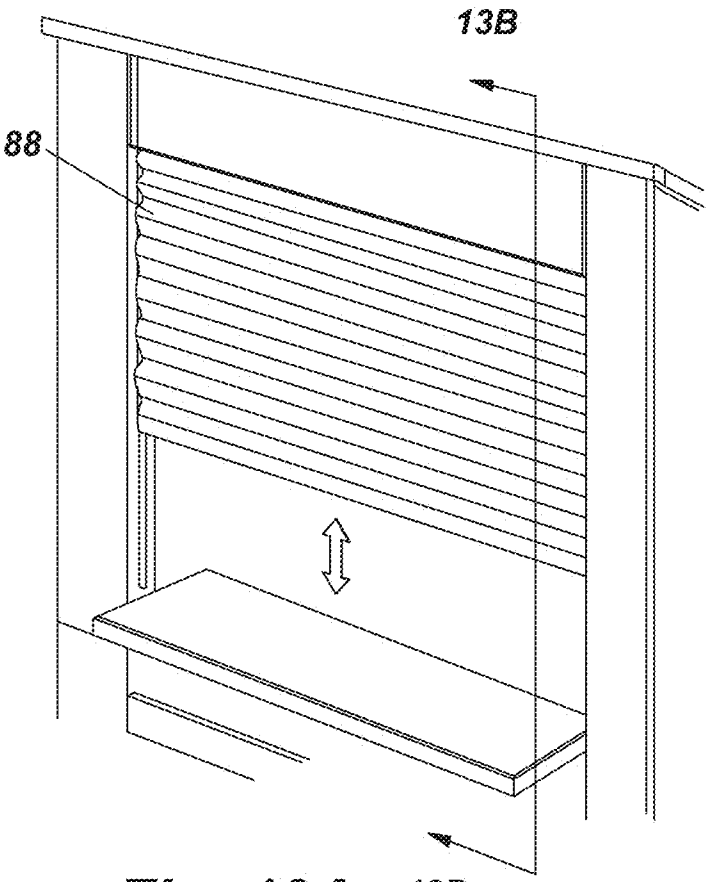
FIG. 13A is a front, right perspective view of a tambour style door suitable for use on the cabana shed.
Figure 13B:
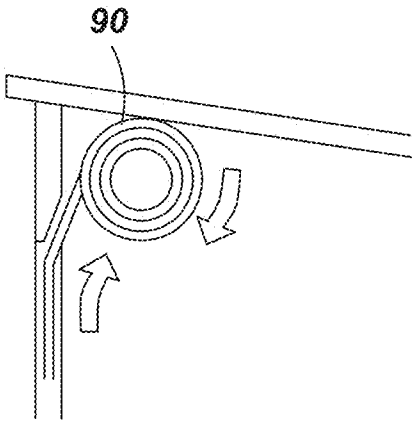
FIG. 13B is a side view taken along lines 13B-13B of FIG. 13A illustrating the track for the tambour style door.
Figures 14A, 14B:
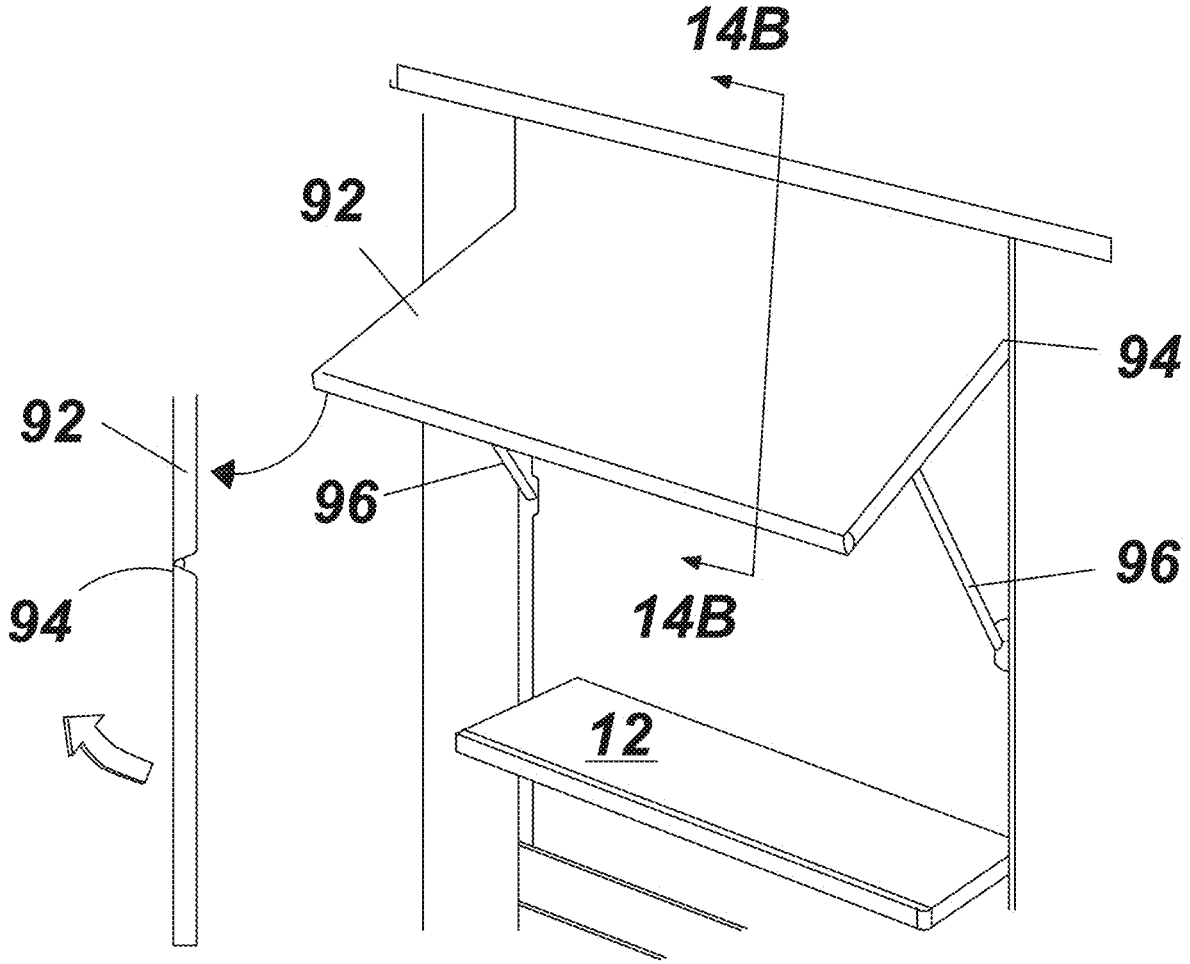
FIG. 14A is a front, right perspective view of a upward lifting door having a living hinge suitable for use on the cabana shed.
FIG. 14B is a side view taken along lines 14B-14B of FIG. 14A illustrating the living hinge style upward lifting door.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring generally to FIGS. 1-30, a cabana shed 10 is illustrated. The cabana shed 10 includes a bar surface 12 that is preferably constructed and arranged to tilt to a position that is inside of the cabana opening 16 and thus inside of the cabana shed so that a cover panel 14 can be pivoted to a position that covers the cabana opening 16. This construction adds security, weatherproofing, and insect resistance to the cabana shed. To create this construction, the cabana shed 10 is comprised of at least two floor panels 18, a plurality of wall panels 20, a plurality of panels 22 and at least one upwardly opening cover panel 14.

In the preferred construction, the panels are manufactured by the process of blow molding to be formed as hollow shells of resin or plastic. The panels include structural ribs 26 and tack-offs 28 to provide rigidity and from the stiffness to the panels. The ribs 26 extend away opposite panel surface and include elongated creases and the like to add stiffness to the panel. The tack-offs 28 are preferably positioned in the valleys between the ribs 26, whereby the bottom surface of the rib is extended to contact and/or attach to the opposite panel surface, attaching the two together. The tack-offs 28 are preferably repeated along the surfaces between the ribs 26 along the full length of the panel in rows and columns. In an alternative embodiment, the upwardly opening cover panel may be constructed using injection molding techniques, whereby the panel only includes a single layer. In these embodiments, the injection molded upwardly opening panel 246 should be formed to include integral side walls 248, ribs 250, and gussets 252. The ribs 250 and gussets 252 serve to make the panel more rigid while not adding a significant amount of weight to the upwardly opening panel. The sidewalls 248 give the panel thickness and rigidity around the perimeter of the panel 246. In this manner, the injection molded panel provides the rigidity of a much heavier panel while retaining the light weight required for lifting the panel vertically and retaining it in the elevated position. This construction also provides increased safety in the event that the panel is dropped. The edges 29 of the panels are constructed to overlap the adjacently positioned panels, and may be secured to the adjacent panels with threaded fasteners or snap-locks as is known in the art. This construction provides weatherproofing and resistance to insect intrusion.

A front portion 30 of the cabana shed 10 preferably includes the cover panel 14 secured to the front portion 30 to rotate upwards about the top edge 32 of the cover panel 14 so that the cover panel 14 extends outwardly over the bar surface 12. This construction provides shade for those standing or sitting at the bar surface 12, and also provides protection from rain and the like. Gas cylinders 34, springs, or the like are utilized to help raise the cover panel 14 and to hold the cover panel 14 in its opened position, as shown in FIG. 1, providing access through the cabana opening 16 for passage of food and drinks and the like. Thus, the hollow blow molded panels or the single layer injection molded panels having the integral ribs and gussets provide a lightweight structure suitable for use with the spring cylinders or springs. In at least one embodiment, windows, fixed 36 and opening 38, are secured within the cover and wall panels 14, 20 respectively. Vents 40 may also be secured within the wall panels 20 to provide ventilation to the cabana shed 10 when either open or closed. A door 42 may be provided to allow easy egress and ingress. The door 42 is secured to the wall panels 20 with hinges 44. A handle 46 is provided for grasping by the user, while a hasp type lock 48 is provided to lock the door 42 to prevent unwanted access to the cabana shed 10. The interior of the cabana shed 10 may include a countertop 50 and undercounter shelving 52. Vertical supports 54 are provided to add weight capacity to the countertop 50 and undercounter shelving 52. This construction also divides the storage space for better organization of stored items.

Referring generally to the figures, and more specifically to FIGS. 8-11, the bar surface 12, and bar surface support assembly 56. The bar surface 12 and support assembly 56 generally cooperate to allow the bar surface 12 to be tilted upward and inward to be stored behind a closed cover panel 14. In order to accomplish the movement, the support assembly 56 includes a fixed position hinge pin 58 and a gusset rod 60 that includes a second fixed hinge pin 62 at a first end 64 thereof and a sliding hinge pin 66 at a second end 68 thereof. The sliding hinge pin 66 is positioned to slide in an elongated slot 70 which limits the travel of the sliding hinge pin 66. Thus, a first end 72 of the elongated slot 70 determines the angle through which the support arm 76 is allowed to travel when the support arm 76 is rotated to the stored position, while the second end 74 determines the resting angle of the support arm 76 with respect to the torque arm 78 of the support assembly. The torque arm 78 is generally an elongated arm that is constructed and arranged for securement to the wall panels 20 on an outer or, more preferably, inner surface thereof. The torque arm 78 is constructed to accept loads applied to the bar surface 12. The bar surface support assembly 56 is preferably constructed from metal to resist bending and allow vertical loads to be transferred through the torque arm 78, along the wall panel 20 to which it is secured, and to a ground surface. In some embodiments, the torque arm 78 may rest on the floor panels 18, which serve to distribute the weight load over an expanded surface area. In some embodiments, a bar surface lock 80 is provided to latch the bar surface 12 in the horizontal position. Thus, the bar surface lock 80 includes a lever 82 which mechanically engages the sliding hinge pin 66 in a manner that prevents the sliding hinge pin from sliding along the elongated slot 70, securing the bar surface 12 in place. Movement of the lever 82 allows the bar surface 12 to be tilted to the stored position. Fasteners or the like may be utilized to attach the torque arms 78 to the wall panels 20.

Still referring generally to the figures, and more specifically to FIGS. 12A-13B, an embodiment of the present invention that includes an upward opening garage style door 84 that only lowers to the bar surface 12 when the bar surface is in the deployed position, and closing to meet the front portion 30 of the shed when the bar surface 12 is folded inwardly. The garage style door 84 follows a door track 86 when opening and closing. In at least one embodiment, the upwardly opening door is a tambour style upwardly opening door 88 which wraps into a tambour coil 90 inside of the cabana shed 10 for storage when the cabana is in use and closes to meet the bar surface or the front portion 30 of the shed.

Figure 15A:
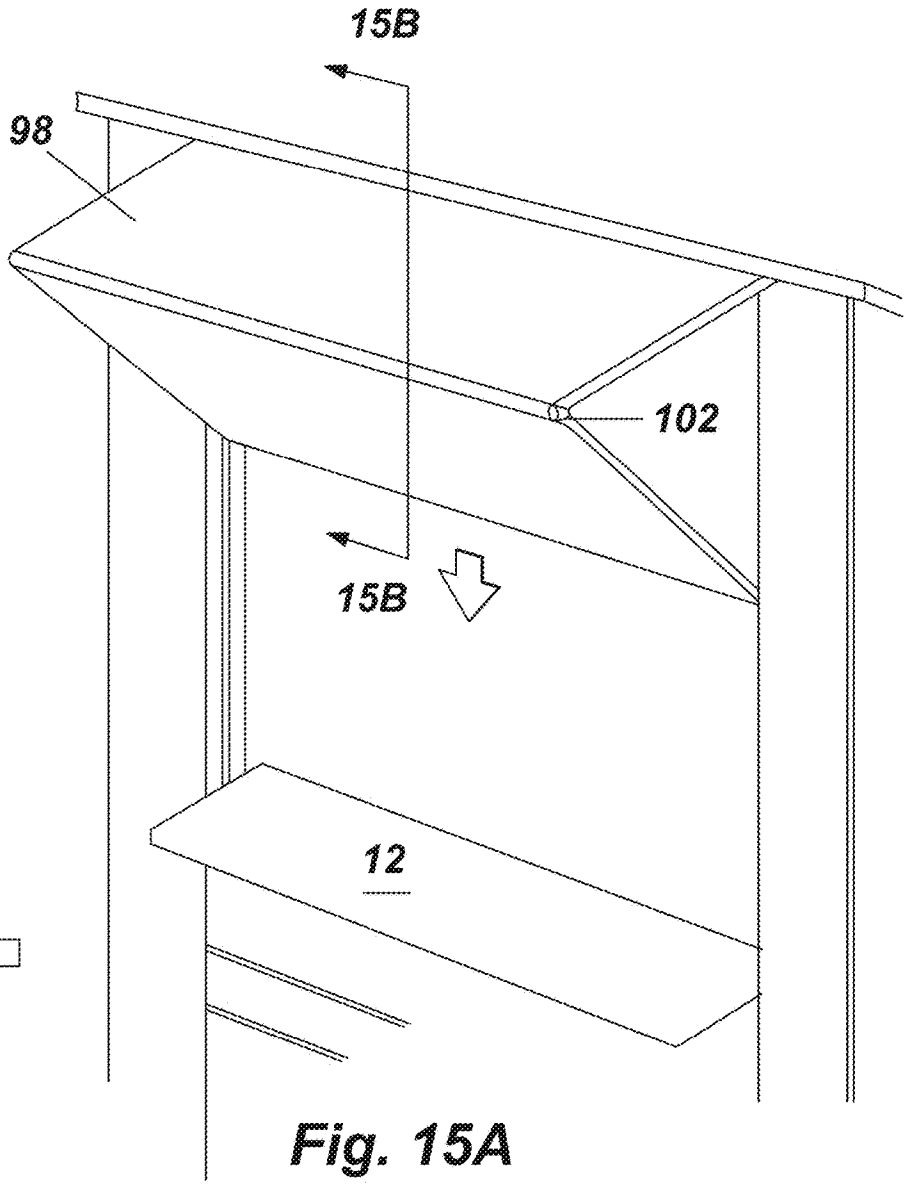
FIG. 15A is a front, right perspective view of a upward lifting door having a pivoting hinge suitable for use on the cabana shed.
Figure 15B:
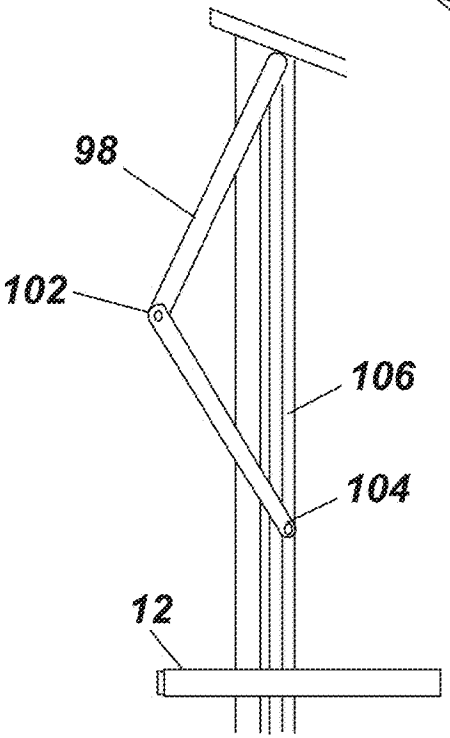
FIG. 15B is a side view taken along lines 15B-15B of FIG. 15A illustrating the pivoting hinge style upward lifting door.

Still referring generally to the figures, and more specifically to FIGS. 14A-15B, an embodiment of the present invention that includes an upward opening one-piece center heading and awning door 92 which includes a living hinge 94 which allows the upwardly opening panel to be moved between the closed and open positions. Support rods 96 or the like are preferably used to hold the panel in the open position. FIGS. 15A and 15B illustrate a two-piece upwardly opening track door 98. The track door 98 includes a panel hinge 102 which bifurcates the track door 98, allowing the lower edge to include track pins 104 which follow panel tracks 106 when the door is moved upwardly.

Figure 16B:
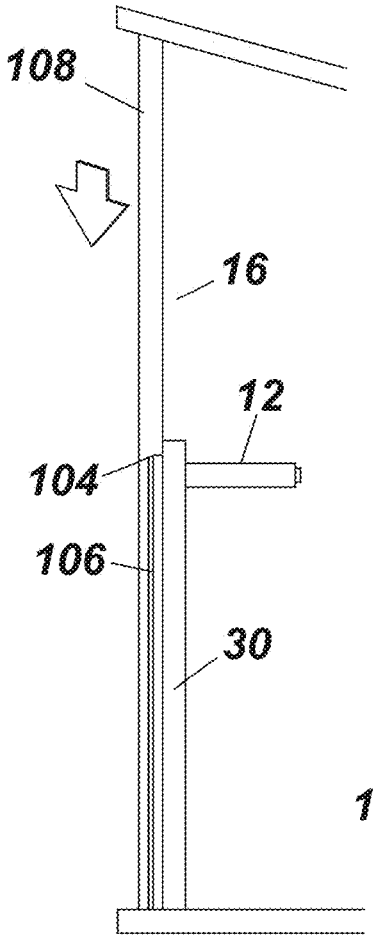
FIG. 16B is a side view taken along lines 16B-16B of FIG. 16A illustrating the upward lifting door.
Figure 16A:
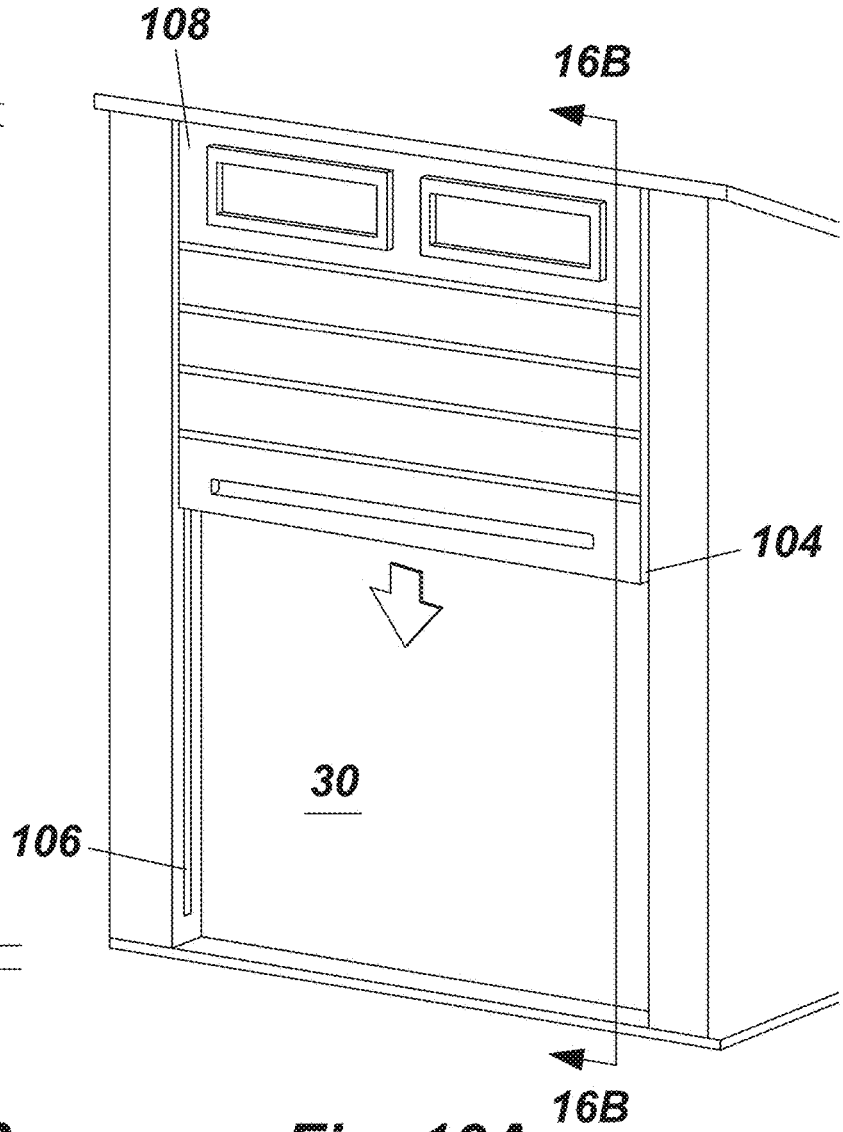
FIG. 16A is a front, right perspective view of a upward lifting door suitable for use on the cabana shed.

Still referring generally to the figures, and more specifically to FIGS. 16A-16B, an embodiment of the present invention that includes a one-piece sliding cover panel 108 is illustrated. The sliding panel moves between a position covering the cabana opening 16 and a lowered position providing access to the bar surface 12. Track pins 104 are provided to cooperate with the track 106 to guide the sliding cover panel 108.

Figures 17A, 17B:
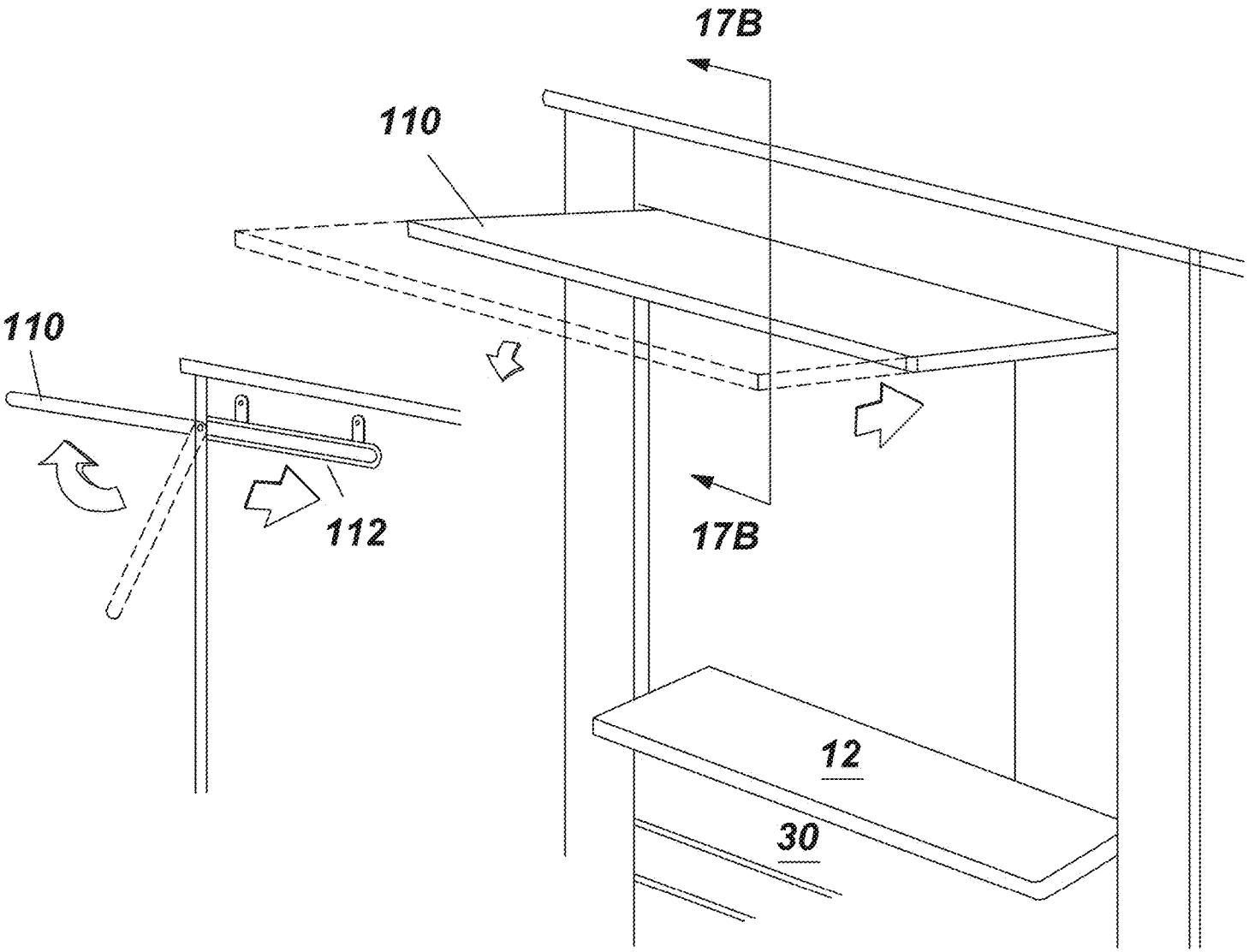
FIG. 17A is a front, right perspective view of a upward lifting door suitable for use on the cabana shed.
FIG. 17B is a side view taken along lines 17B-17B of FIG. 17A illustrating the upward lifting door.
Figure 18A:
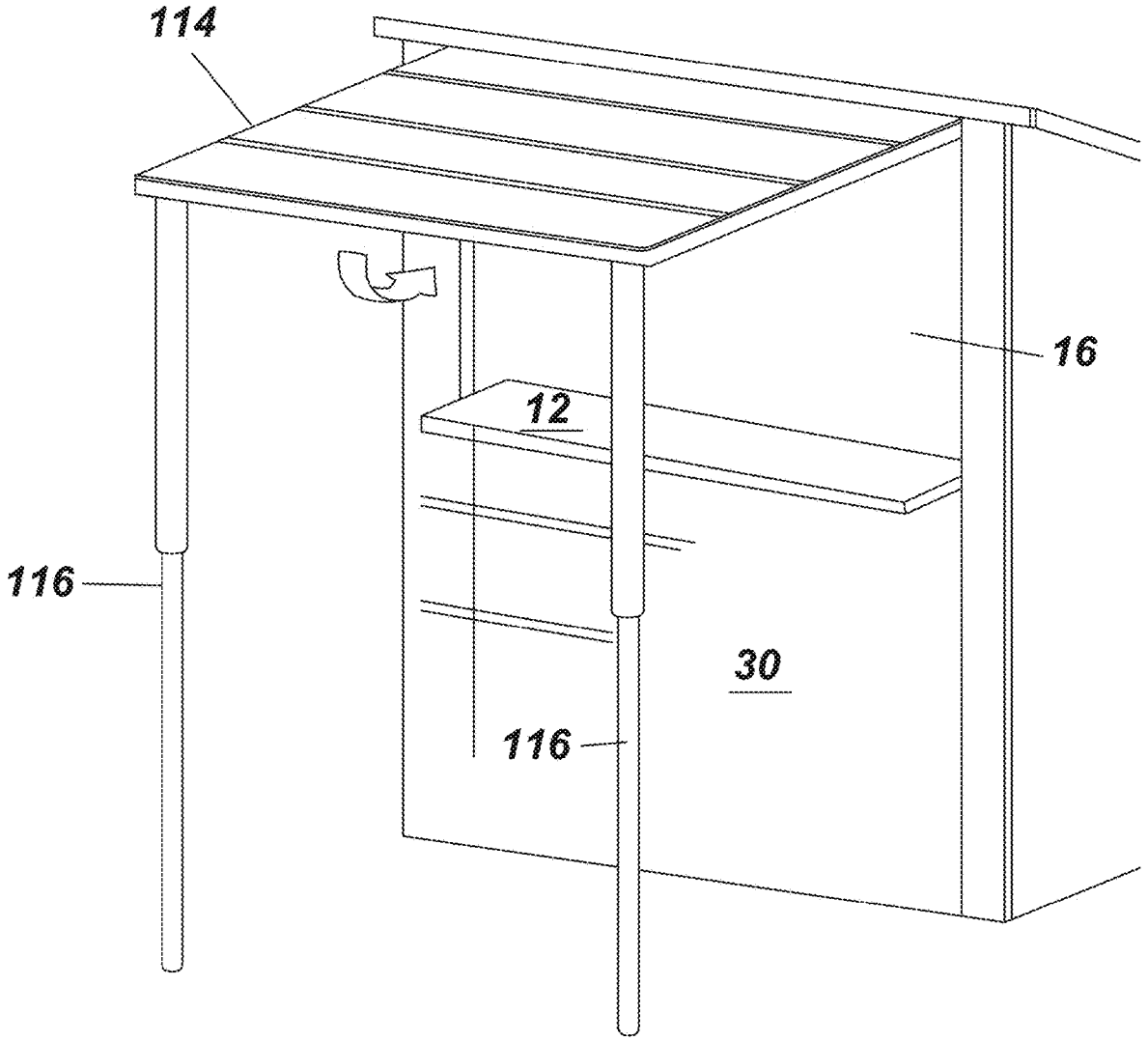
FIG. 18A is a front, right perspective view of a upward lifting door having removable support poles for use on the cabana shed.
Figure 18B:
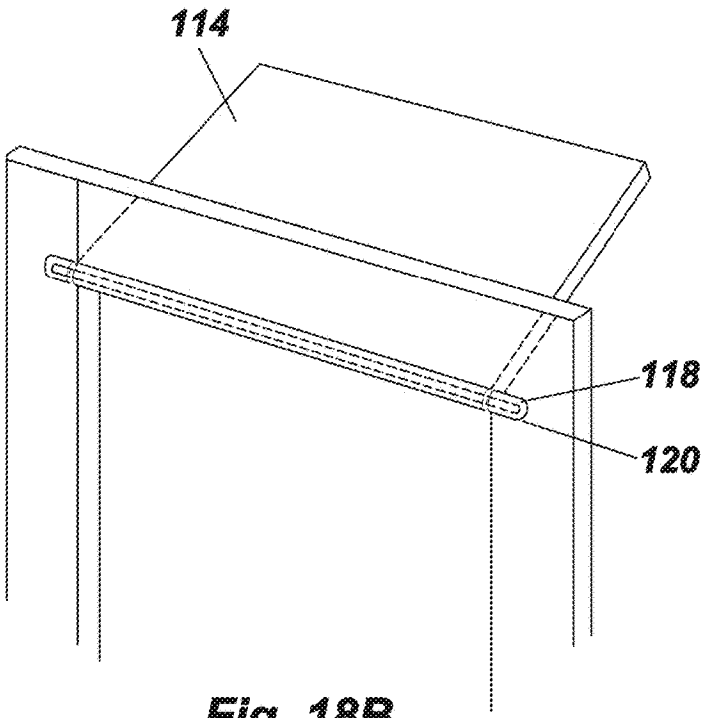
FIG. 18B is a top, front, right, perspective view illustrating the upward opening door pivoting inwardly with respect to the cabana shed.
Figure 18C:
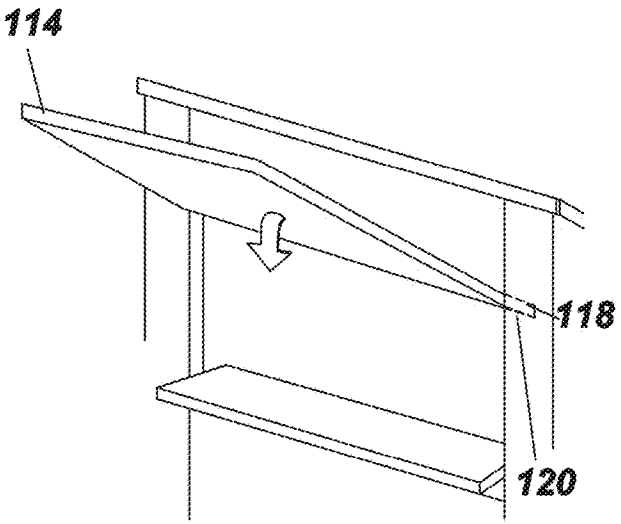
FIG. 18C is a top, front, right, perspective view illustrating the upward opening door pivoting outwardly with respect to the cabana shed.
Figure 18D:
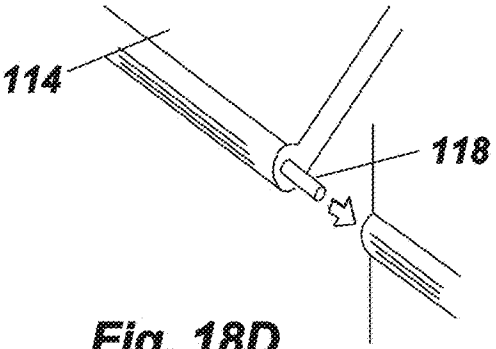
FIG. 18D is a perspective view illustrating the connection of the upwardly opening door to the shed walls.

Still referring generally to the figures, and more specifically to FIGS. 17A-17B, an embodiment of the present invention that includes an upward opening pocket panel 110 is illustrated. The pocket panel pivots upwardly and then slides into the pocket track 112.

Still referring generally to the figures and more specifically to FIGS. 18A-18D, an embodiment of the present invention that includes an upward opening full panel 114 is illustrated. The full panel 114 pivots around a top surface of the panel and is supported in position by support poles 116. In an alternative embodiment, air cylinders or the like may be utilized to hold the full panel 114 in the open position. This is made possible by the lightweight construction of the blow molded or injection molded panels. Panel pins 118 or the like fit into hinge sockets 120 around which the panel pivots.

Figure 19A:
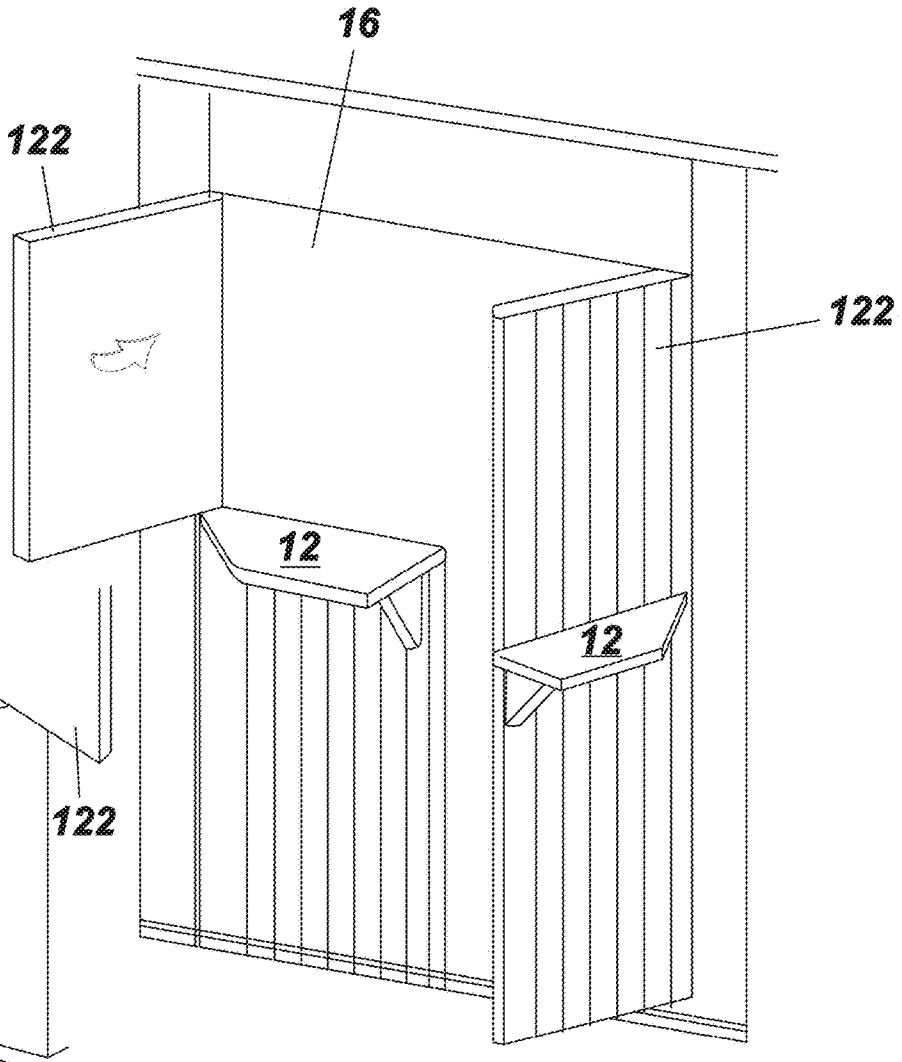
FIG. 19A is a top, front, right perspective view illustrating split doors for creating a cabana shed.
Figure 19B:
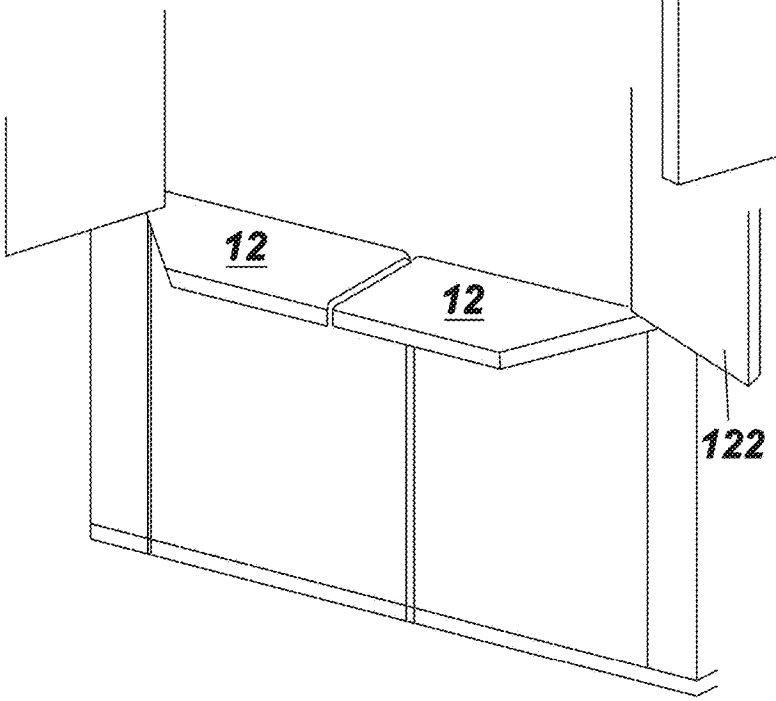
FIG. 19B is a top, front, right perspective view illustrating the top portion of the split doors open for creating a cabana shed.

Still referring generally to the figures and more specifically to FIGS. 19A and 19B, an embodiment of the present invention that includes a pair of split doors 122 is illustrated. The split doors 122 open to provide access to the cabana opening 16 and allow use of the bar surface 12.

Figure 19C:
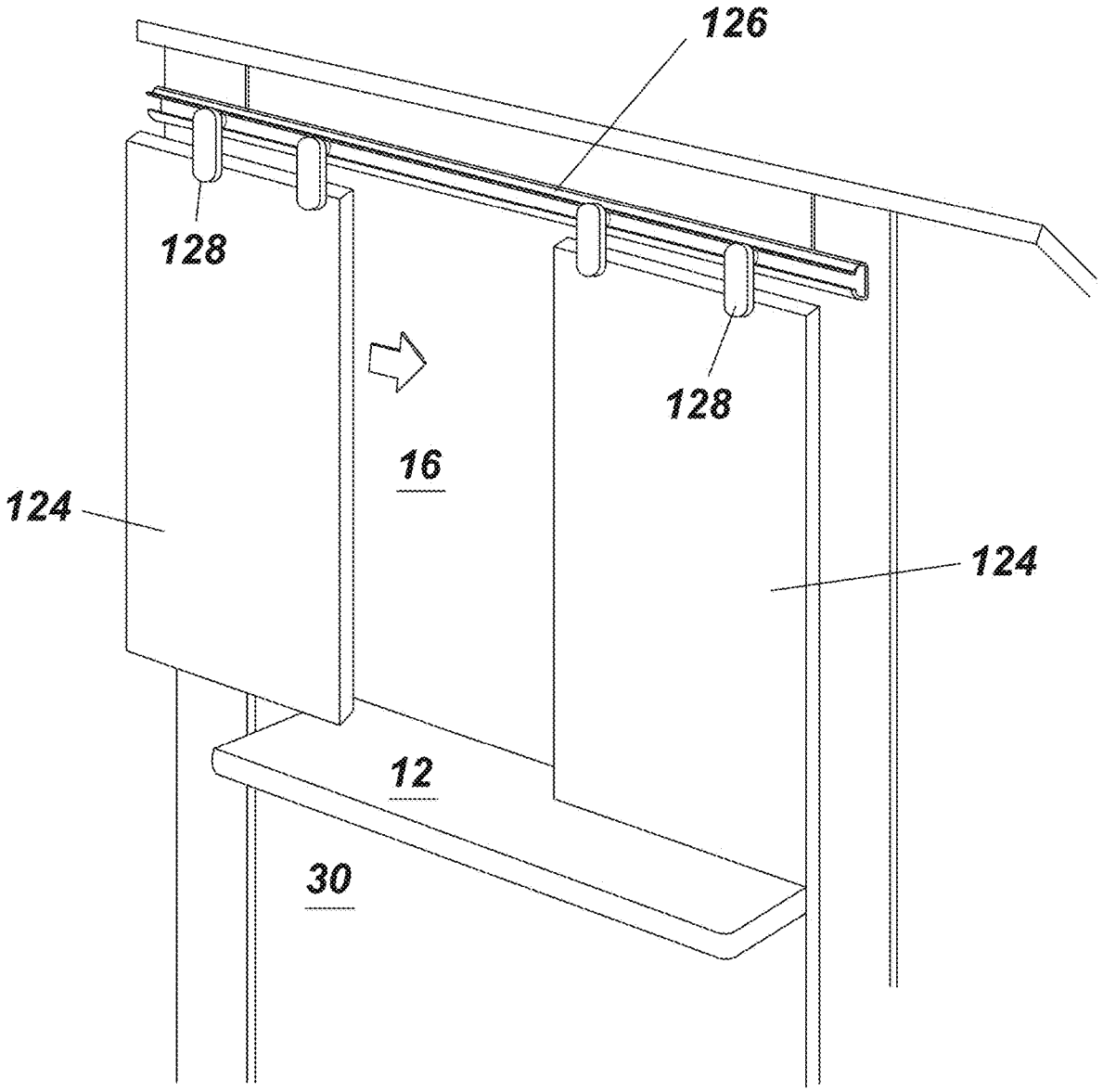
FIG. 19C is a top, front, right perspective view illustrating split barn style doors for creating the cabana shed.

Still referring generally to the figures and more specifically to FIG. 19C, an embodiment of the present invention that includes a pair of barn doors 124 is illustrated. The barn doors include a barn door track 126 and barn door rollers 128 which cooperate to allow the barn doors 124 to open and close, providing access to the cabana opening 16 and bar surface 12. In this embodiment, the bar surface 12 may be retractable to completely close the cabana opening.

Figure 20A:
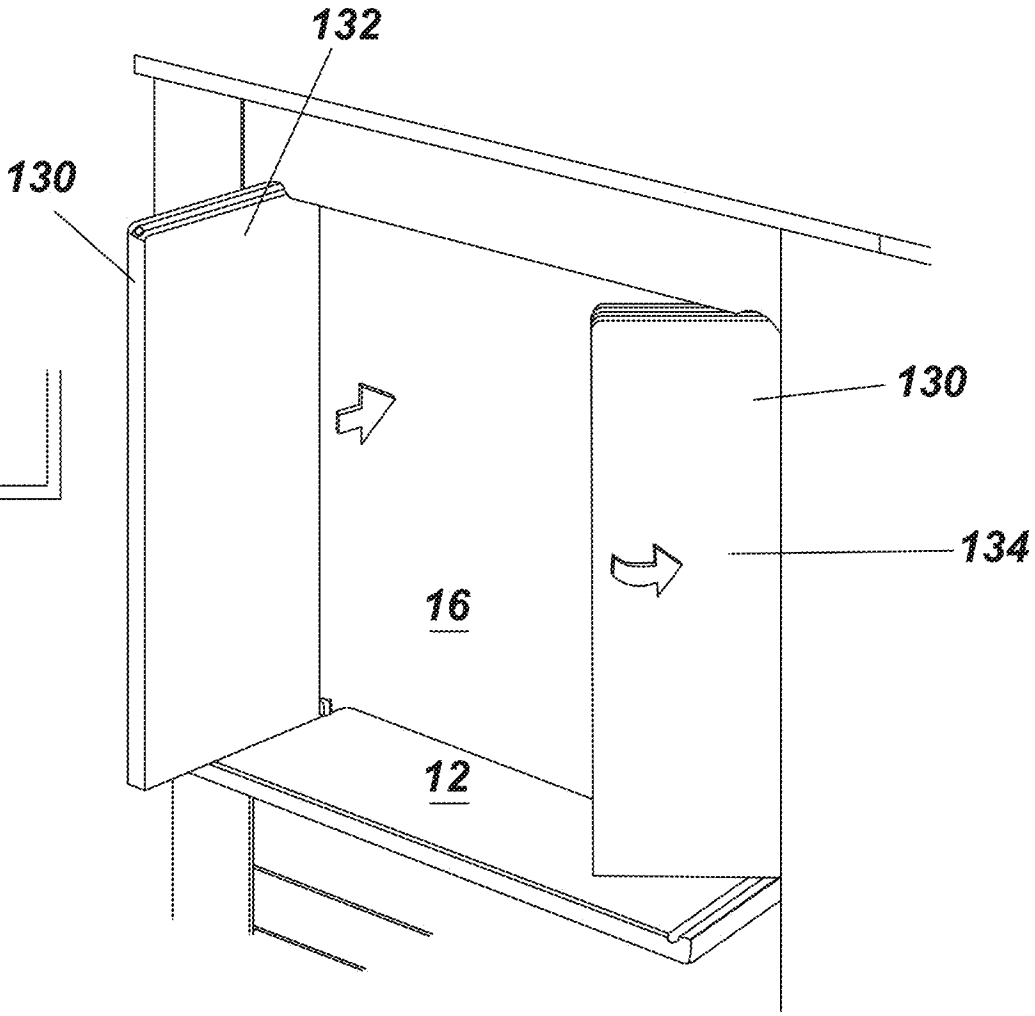
FIG. 20A is a top, front, right perspective view illustrating armoire style doors for creating the cabana shed.
Figure 20B:
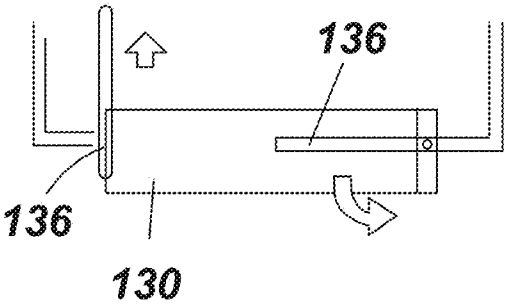
FIG. 20B is a partial view illustrating the motion of the armoire style doors.

Still referring generally to the figures and more specifically to FIGS. 20A and 20B, an embodiment of the present invention that includes a of armoire doors 130 is pair illustrated. The armoire doors 130 are constructed and arranged to fold and slide into the cabana opening 16. A first armoire door 132 folds to a position substantially parallel to the second armoire door 134. Both doors 132, 134 can then be rotated to the open position, which is about 90 degrees from the closed position, allowing both doors to slide along an armoire track 136 into the cabana opening 16.

Figure 21:
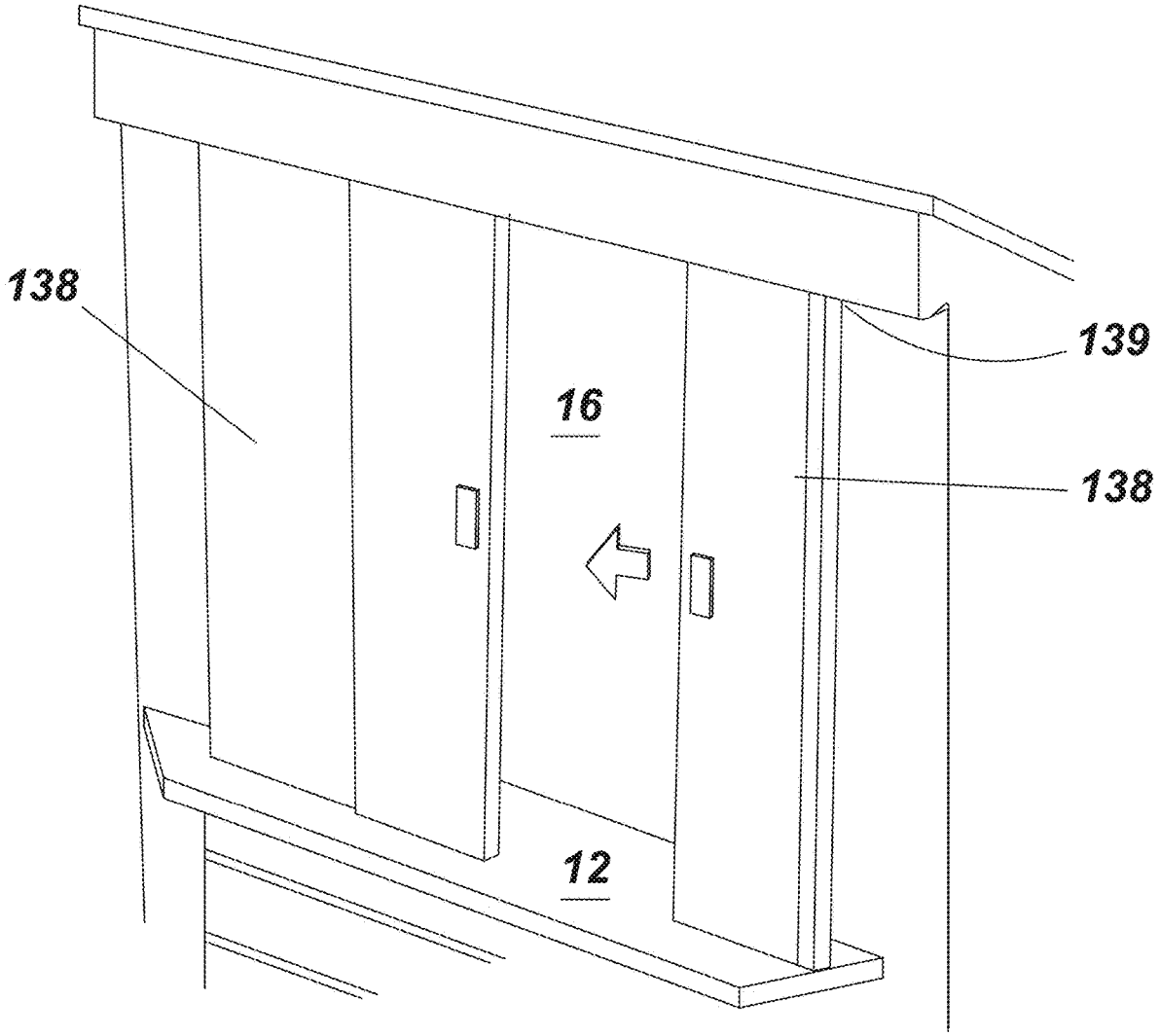
FIG. 21 is a top, front, right perspective view illustrating bypass sliding style doors for creating the cabana shed.

Still referring generally to the figures, and more specifically to FIG. 21, an embodiment of the present invention that includes sliding bypass doors 138 is illustrated. The sliding bypass doors 138 hang in bypass door tracks 139, wherein two opposing doors are on each track. This construction allows one door to pass in front of the other for storage at the area beside the cabana opening 16.

Figure 22B:
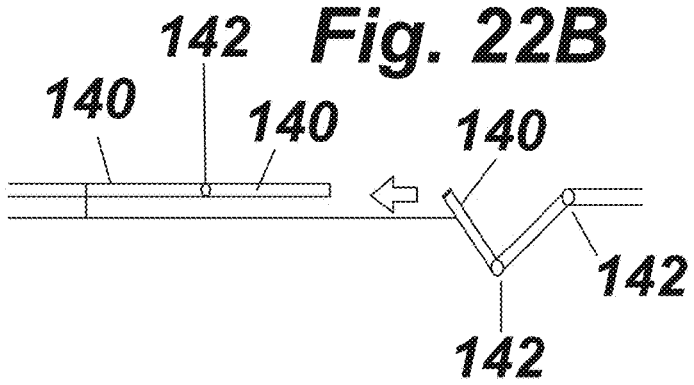
FIG. 22B is a top view illustrating the motion provided by the bi-fold doors.
Figure 22A:
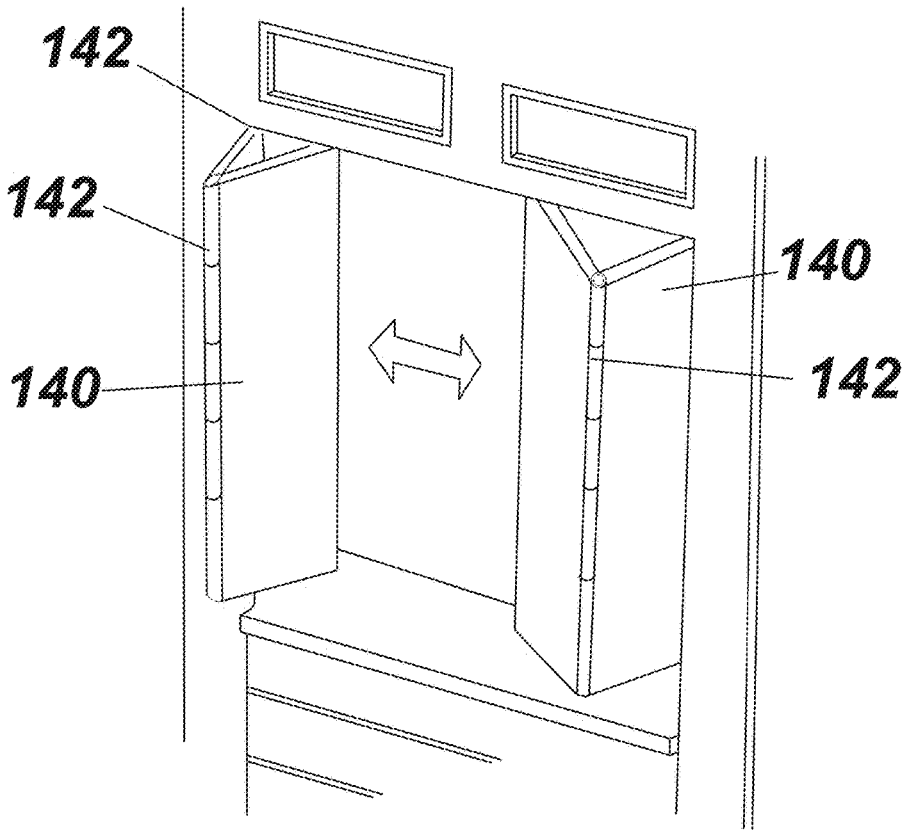
FIG. 22A is a top, front, right perspective view illustrating bi-fold style doors for creating the cabana shed.

Still referring generally to the figures and more specifically to FIGS. 22A and 22B, an embodiment of the present invention that includes bi-fold doors 140 is illustrated. The bi-fold doors 140 include a bi-fold door hinge 142, allowing the bi-fold doors to be positioned at the outer edges of the cabana opening 16.

Still referring generally to the figures, and more specifically to FIGS. 23A-23C, an embodiment of the present invention that includes a sliding bar surface 212 is illustrated. One embodiment of the sliding bar surface 212 includes a slotted plate 214 that cooperates with slider pins 216 or bearings to allow the bar surface to be moved into or out of the cabana opening 16. In this manner, the cover panel 14 can cover the entire cabana opening 16 when the bar surface is in a retracted or storage position. This construction allows objects to be stored on the bar surface as it is moved into and out of the cabana opening.

Figure 24A:
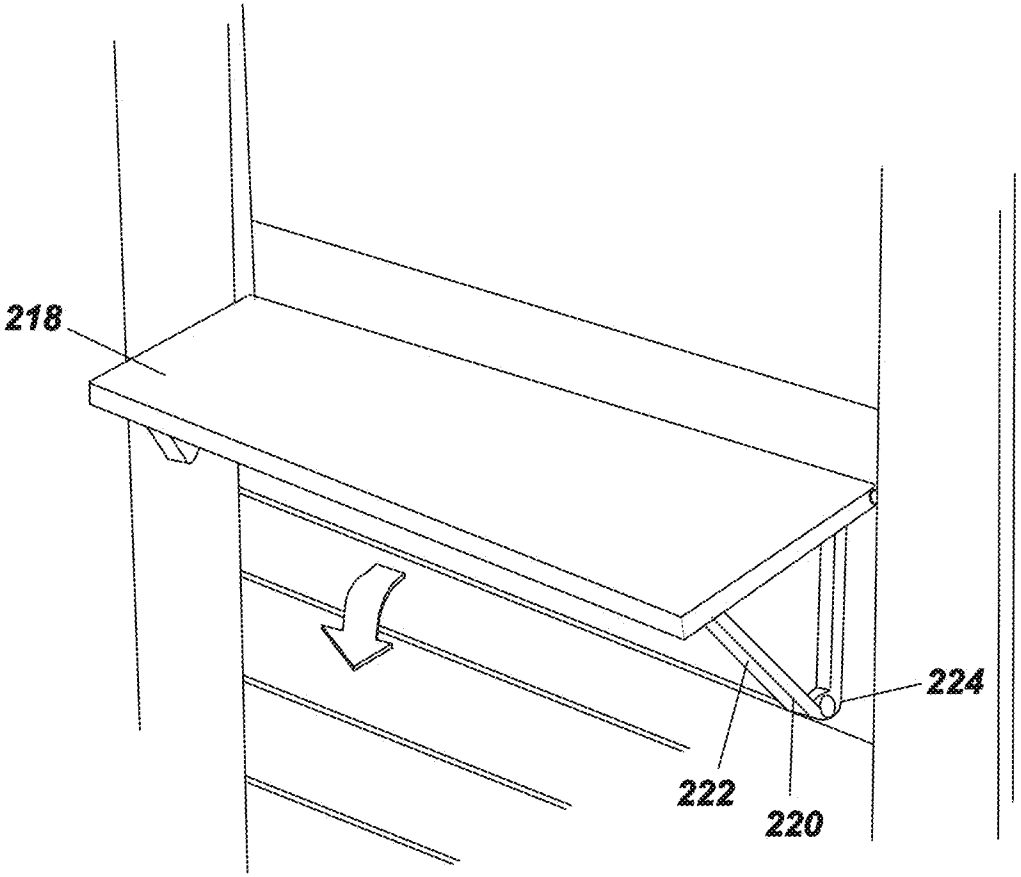
FIG. 24A is a top, front, right perspective view illustrating a tilting bar surface for creating the cabana shed.
Figure 24B:
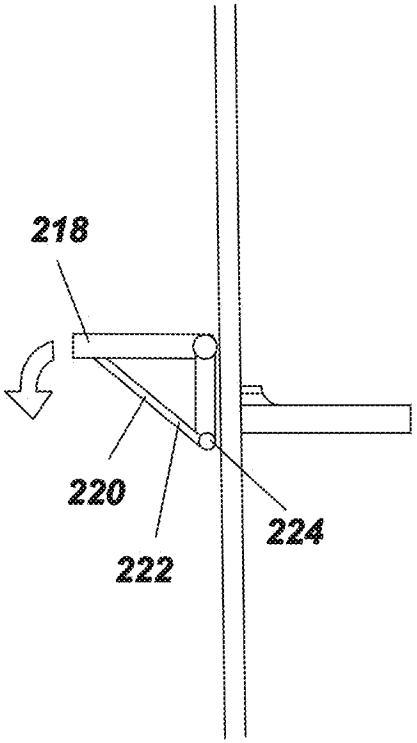
FIG. 24B is a side view illustrating the motion provided by the tilting bar surface.

Still referring generally to the figures and more specifically to FIGS. 24A and 24B, an embodiment of the present invention that includes an outside folding bar surface 218 is illustrated. The outside folding bar surface 218 includes a bar support assembly 220 having a moveable support 222 which allows the bar surface 218 to pivot upwards or downwards around bar surface hinge pin 224. The bar support assembly 220 can be moved into position to support the bar surface, wherein the bottom of the bar surface includes a socket into which the moveable support cooperates to hold the shelf in position.

Figure 25A:
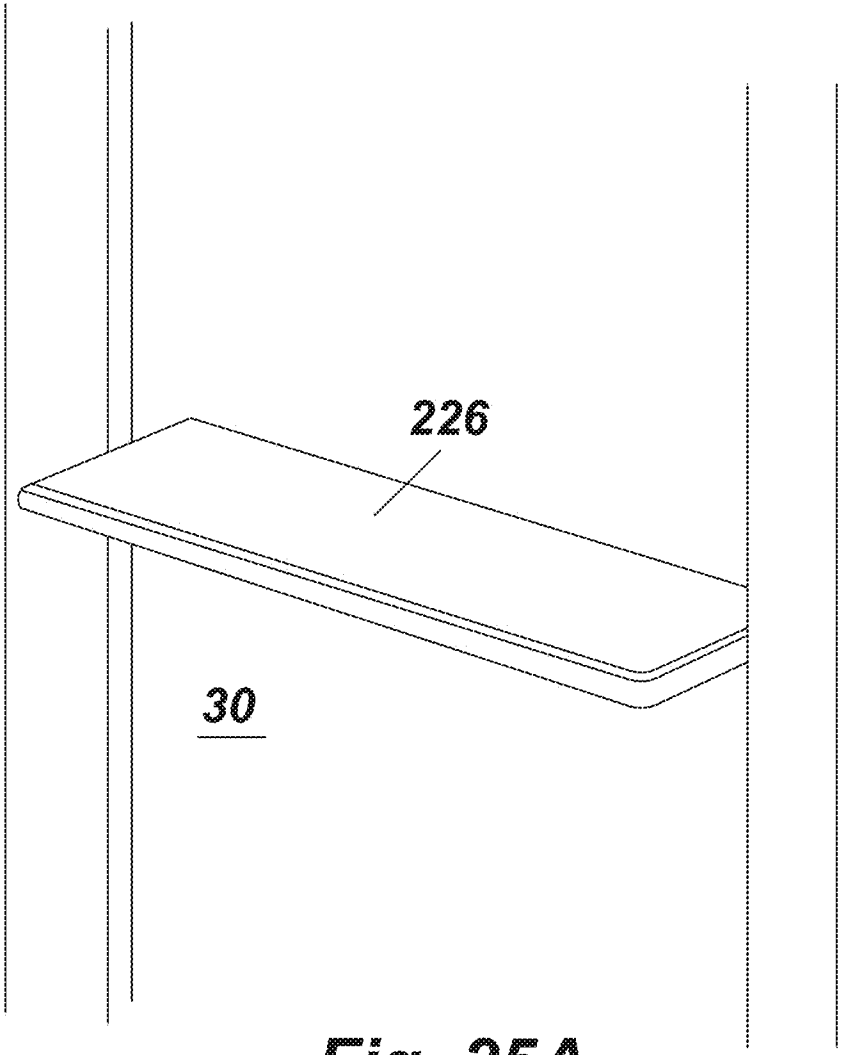
FIG. 25A is a top, front, right perspective view illustrating a fixed bar surface for creating the cabana shed.
Figure 25B:
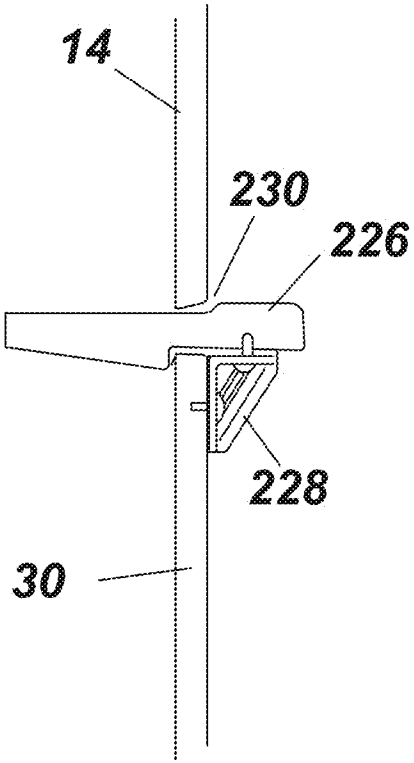
FIG. 25B is a partial side view illustrating the fixed bar surface.

Still referring generally to the figures and more specifically to FIGS. 25A and 25B, an embodiment of the present invention that includes a fixed bar surface 226 is illustrated. The fixed bar surface 226 includes a mounting bracket 228 for securing the bar surface to the front portion 30 of the cabana shed 10. In at least one embodiment, the bar surface includes an offset 230 which cooperates with the cover panel 14 to reduce or prevent rain and bug ingress into the cabana shed 10.

Figure 26A:
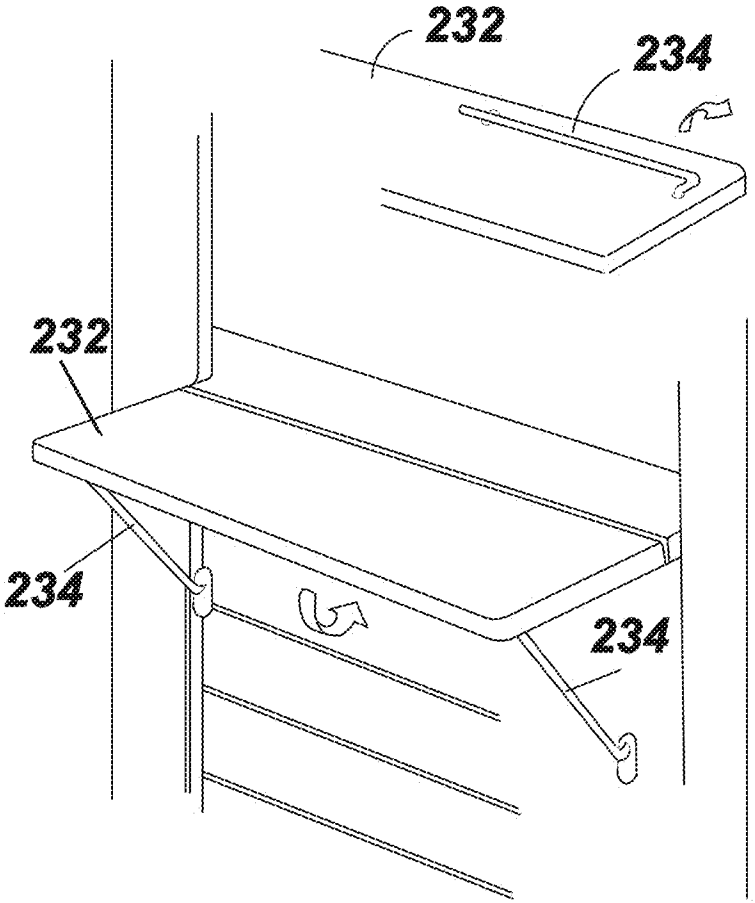
FIG. 26A is a top, front, right perspective view illustrating a tilting bar surface having a living hinge for creating the cabana shed.
Figure 26B:
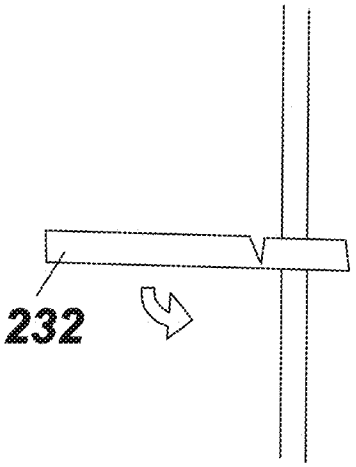
FIG. 26B is a partial side view illustrating the living hinge arrangement for tilting the bar surface.

Still referring generally to the figures and more specifically to FIGS. 26A and 26B, an embodiment of the present invention that includes a folding bar surface with living hinge 232 is illustrated. The bar surface can thus be folded downward by folding the prop rods 234 into the bottom surface of the bar surface 232. This process is reversible to place the bar surface in the proper position for use.

Figure 27A:
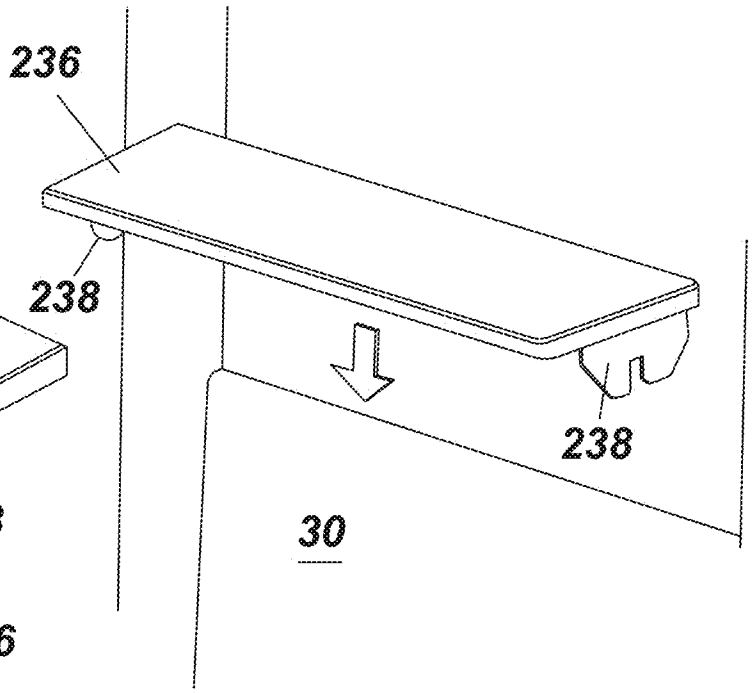
FIG. 27A is a top, front, right perspective view illustrating a removable bar surface for creating the cabana shed.
Figure 27B:
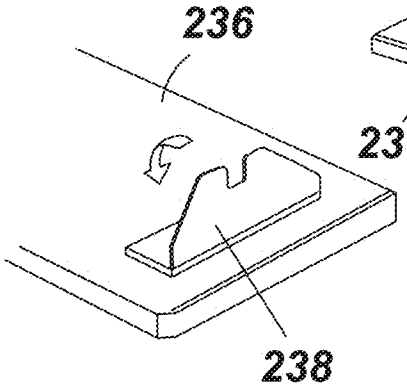
FIG. 27B is a partial perspective view illustrating stamped attachment brackets for the bar surface.
Figure 27C:
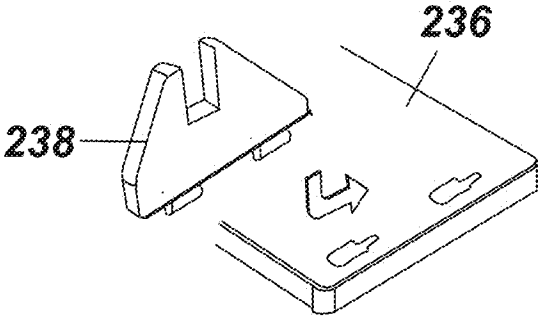
FIG. 27C is a partial perspective view illustrating molded attachment brackets for the bar surface.

Still referring generally to the figures and more specifically to FIGS. 27A-27C, an embodiment of the present invention that includes a removable bar surface 236 is illustrated. The removable bar surface 236 includes a pair of saddle brackets 238. The saddle brackets 238 may be constructed from metal or, alternatively, they may be constructed from plastic or wood, or suitable combinations thereof, without departing from the scope of the invention. The saddle brackets 238 may be attached using fasteners, dovetails, interlocking notches, etc.

Figure 28A:
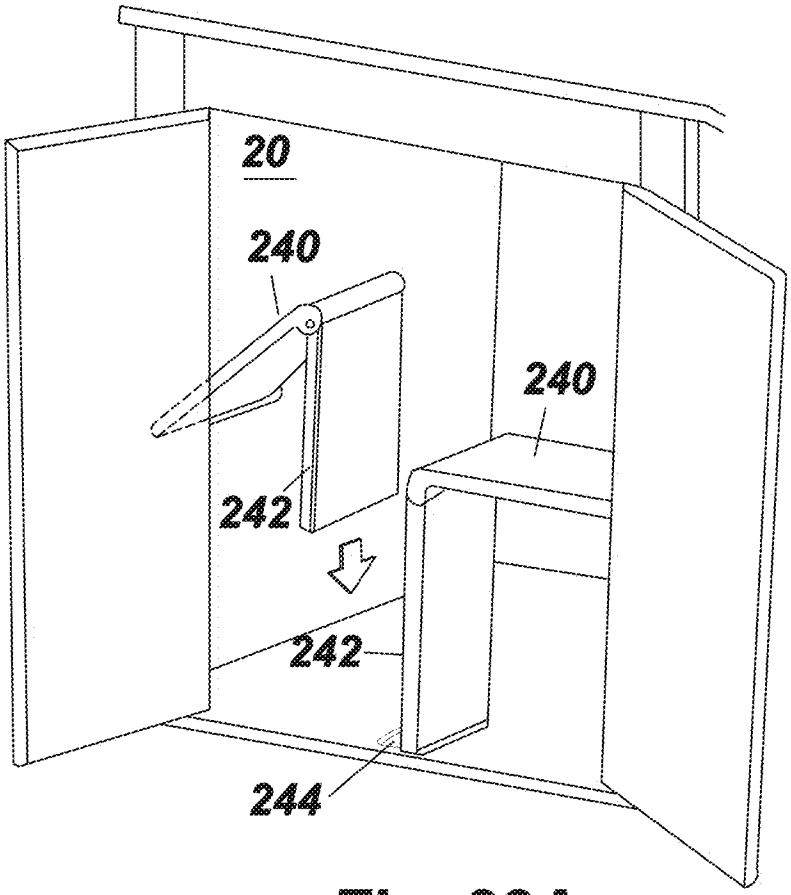
FIG. 28A is a top, front, right perspective view illustrating a foldable bar surface for creating the cabana shed.
Figure 28B:
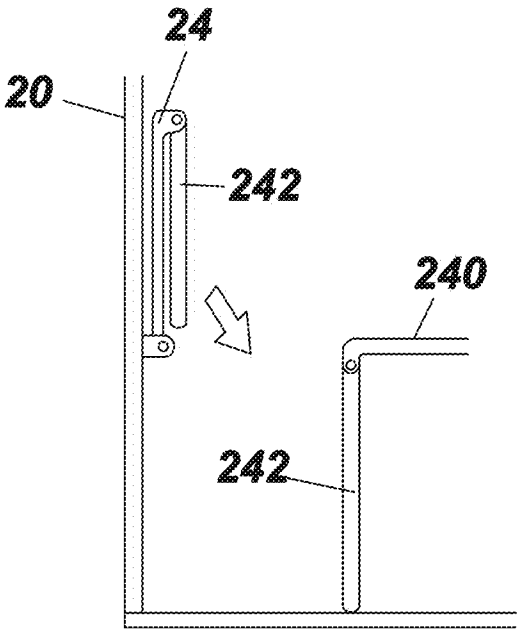
FIG. 28B is a partial side view illustrating the motion of the foldable bar surface.

Still referring generally to the figures and more specifically to FIGS. 28A and 28B, an embodiment of the present invention that includes a lifting bar surface 240 is illustrated. The lifting bar surface includes a pivotally mounted support pedestal 242 which, due to gravity, automatically positions itself as the bar surface is lowered. Floor detents are provided to cooperate with the lowermost surface of the support pedestal 242 to reduce the possibility of the pedestal tipping due to loads on the bar surface. In this embodiment, the bar surface 240 may be raised to a position substantially adjacent to the inner surface of the cabana wall panels. This allows the shed to be used as a shed and as a cabana.

Figure 29:
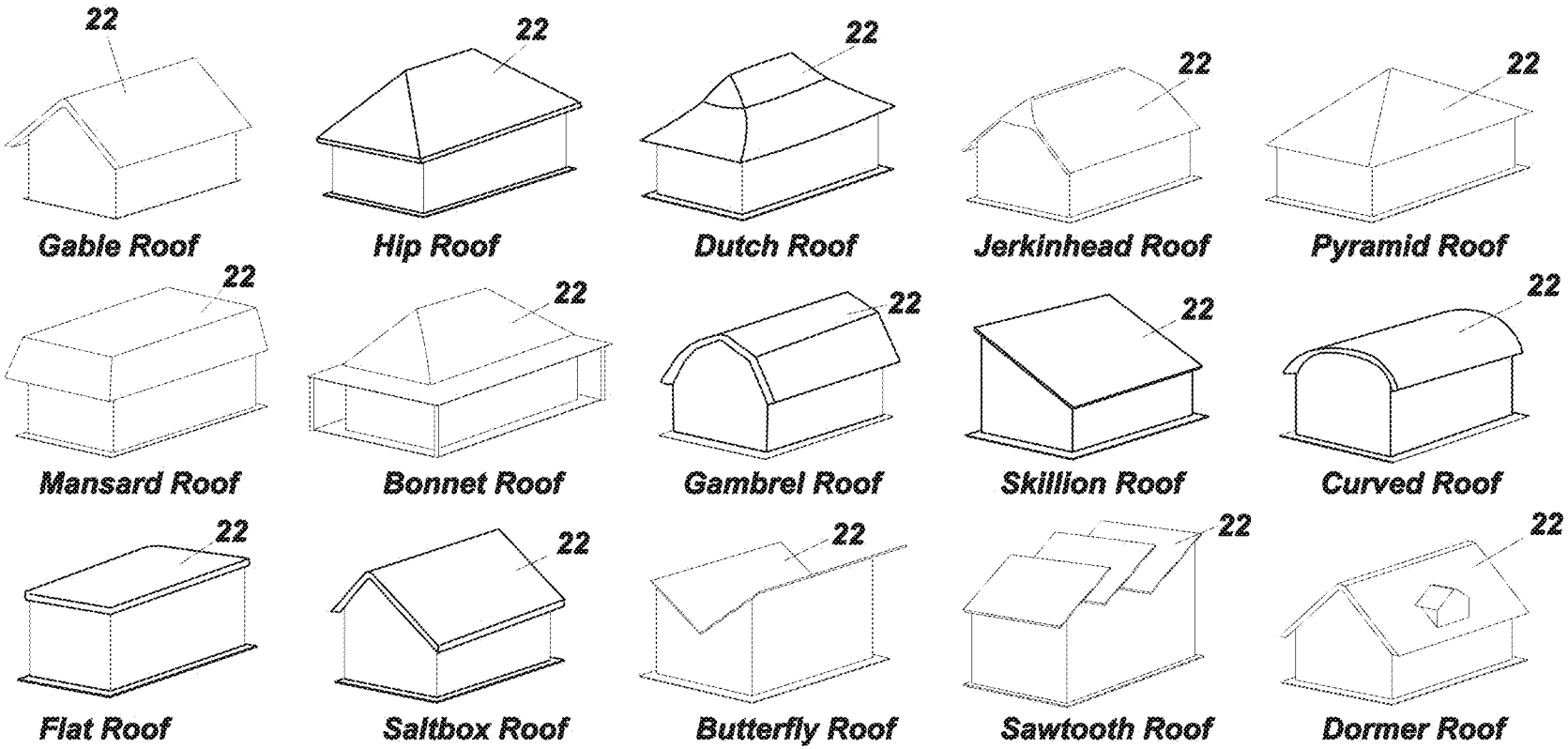
FIG. 29 is a perspective view illustrating various types of roof constructions that are applicable to the present cabana bar.
Figure 30:
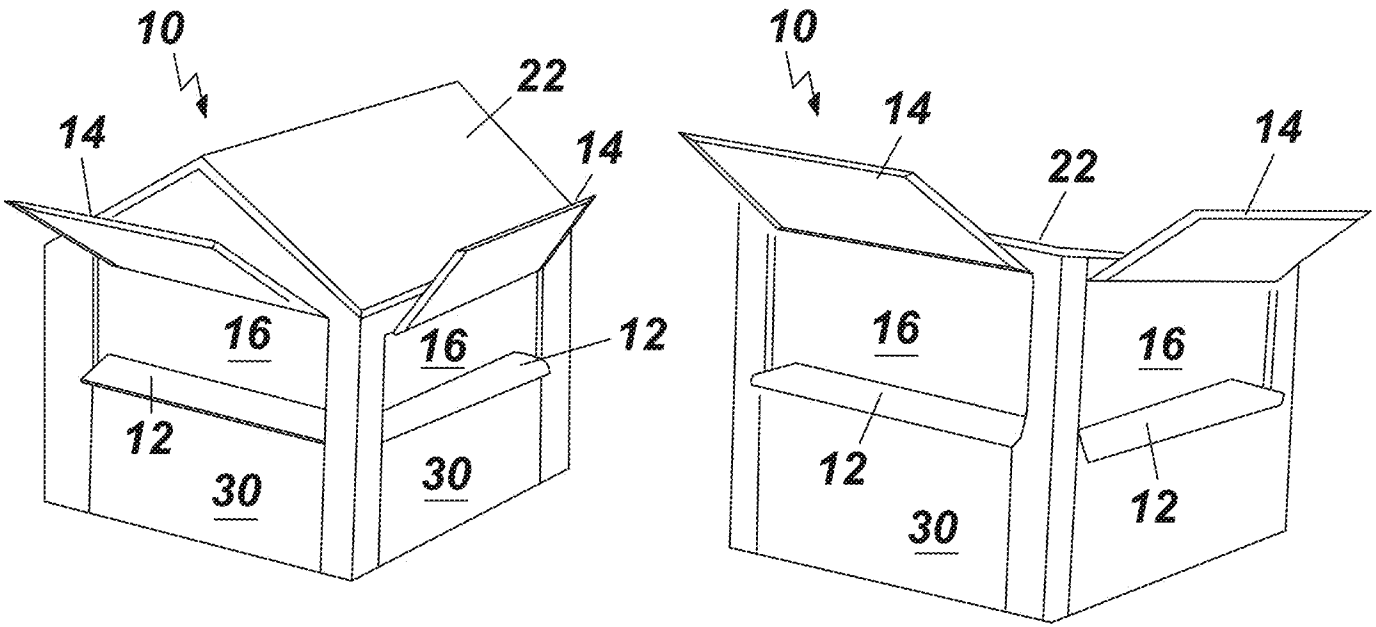
FIG. 30 illustrates that there can be more than one upward pivoting panel as part of the Cabana shed.

Still referring generally to the figures and more specifically to FIGS. 29 and 30, variety of roof types suitable for use with the present cabana shed are illustrated. The tilting bar surface and the upwardly moveable cover panel may be utilized with most all types of roofs without from the scope of the invention. It should also be noted that while only one bar surface and upward opening cover panel are illustrated in most of the figures, the cabana shed may include any number of bar surfaces and upwardly opening cover panels without departing from the scopes of the invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objects and obtain the ends and advantages mentioned, as well as those inherent therein. Any compounds, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A cabana shed comprising:

at least one floor panel for providing a base surface for supporting a plurality of wall panels in a vertical orientation, side edges of the wall panels overlapping adjacently positioned wall panels and secured together, a plurality of roof panels connected to a top edge surface of the wall panels, at least one wall of the cabana shed includes a cabana opening wherein the wall panels are shorter to provide the cabana opening between a top portion of the shorter wall panels and the roof panel, at least one upwardly opening cover panel is provided to cover the cabana opening when in a closed position, the cover panel opening in an upward manner to provide access through the cabana opening, a bar surface positioned at a lowermost portion of the cabana opening, the bar surface being constructed and arranged to rotate between a use position wherein the bar surface is oriented horizontally having at least a portion of the bar surface extending through the cabana opening and protruding beyond an outside surface of the wall panel and a second vertical position wherein the bar surface is positioned inside the outside surface of the wall panel so that the cover panel can be lowered to a closed position that covers the cabana opening, the cover panel having an outer wall, the outer wall having an outer surface visible from the outside of the cabana shed and an inner surface having integrally formed reinforcements thereon, the integral reinforcements providing structural rigidity to the cover panel such that the panel may be lifted from a bottom surface thereof to a position above the bar surface providing access to the cabana opening.

2. The cabana shed of claim 1 wherein the bar surface includes a bar surface support assembly, the bar surface and bar surface support assembly cooperate to allow the bar surface to be tilted upward and inward to be stored behind the cover panel while the cover panel is in the closed position.

3. The cabana shed of claim 2 wherein the bar surface support assembly includes a fixed position hinge pin and a gusset rod, the gusset rod includes a second fixed hinge pin at a first end thereof and a sliding hinge pin at a second end thereof.

4. The cabana shed of claim 3 wherein the sliding hinge pin is positioned to slide in an elongated slot which limits the travel of the sliding hinge pin such that a first end of the elongated slot determines the angle through which a support arm is allowed to travel when the support arm is rotated to a stored position, while a second end of the elongated slot determines the resting angle of the support arm with respect to a torque arm of the support assembly.

5. The cabana shed of claim 4 wherein the torque arm is generally an elongated arm that is constructed and arranged for securement to the wall panels on an inner surface thereof for accepting loads applied to the bar surface and transferring them to the wall panels.

6. The cabana shed of claim 4 wherein the torque arm rests on the floor panels to distribute the weight load applied to the bar surface over an expanded surface area.

7. The cabana shed of claim 4 wherein a bar surface lock is provided to latch the bar surface in the horizontal position.

8. The cabana shed of claim 7 wherein the bar surface lock includes a lever which mechanically engages the sliding hinge pin in a manner that prevents the sliding hinge pin from sliding along the elongated slot for securing the bar surface in the horizontal position.

9. The cabana shed of claim 1 wherein the cover panel is secured to a front portion of the cabana shed to rotate upwards about a top edge of the cover panel so that the cover panel extends outwardly over the bar surface.

10. The cabana shed of claim 1 wherein the cover panel is formed from resin to be a single layer hollow structure having integrally formed strengthening ribs to provide rigidity to the cover panel.

11. The cabana shed of claim 10 wherein the cover panel is manufactured by the process of blow molding to include two panels integrally connected around the perimeter thereof, the walls having a plurality of areas where one wall extends to and is connected to the other wall to form a tack off to connect the two panels in a central portion of the panels, while they remain spaced apart.

12. The cabana shed of claim 11 wherein at least one of the two panels includes ribs formed along the length of the panel, the ribs extending toward the other panel, the tack offs positioned in a bottom portion of the rib.

13. The cabana shed of claim 10 wherein the cover panel is formed by the process of injection molding to include integrally formed ribs and gussets for providing structural rigidity to the cover panel.

14. The cabana shed of claim 10 wherein the resin is plastic.

* * * * *